US007841413B1

(12) United States Patent
Robichaux et al.

(10) Patent No.: US 7,841,413 B1
(45) Date of Patent: Nov. 30, 2010

(54) PRE-MADE UP SIDE ENTRY SUB APPARATUS AND METHOD

(75) Inventors: Terry P. Robichaux, Houma, LA (US); Ron Robichaux, Houma, LA (US); Kenneth G. Caillouet, Thibodaux, LA (US)

(73) Assignee: Mako Rentals, Inc., Houma, LA (US)

( * ) Notice: Subject to any disclaimer, the term of this patent is extended or adjusted under 35 U.S.C. 154(b) by 72 days.

(21) Appl. No.: 12/364,779

(22) Filed: Feb. 3, 2009 (Under 37 CFR 1.47)

Related U.S. Application Data

(60) Provisional application No. 61/025,969, filed on Feb. 4, 2008.

(51) Int. Cl.
*E21B 19/00* (2006.01)
*E21B 17/00* (2006.01)
*E21B 7/00* (2006.01)

(52) U.S. Cl. ..... 166/379; 166/242.5; 175/57

(58) Field of Classification Search ..... 166/75.11, 166/70, 379, 242.5; 175/57, 203, 211, 213, 175/218; 248/123.11, 123.2, 162.1
See application file for complete search history.

(56) References Cited

U.S. PATENT DOCUMENTS 1,708,584 A * 4/1929 Mason ..... 91/350
4,722,389 A * 2/1988 Arnold ..... 166/70
7,007,753 B2 * 3/2006 Robichaux et al. ..... 166/291
7,281,582 B2 * 10/2007 Robichaux et al. ..... 166/291
2007/0095544 A1 * 5/2007 Boyd ..... 166/385
2007/0137864 A1 * 6/2007 Boyd ..... 166/380
2007/0272403 A1 * 11/2007 Robichaux et al. ..... 166/85.1
2009/0025930 A1 * 1/2009 Iblings et al. ..... 166/244.1

* cited by examiner

*Primary Examiner*—William P Neuder
*Assistant Examiner*—Michael Wills, III
(74) *Attorney, Agent, or Firm*—Garvey, Smith, Nehrbass & North, L.L.C.; Brett A. North

(57) ABSTRACT

For use with a top drive power unit supported for connection with a well string in a well bore to selectively impart longitudinal and/or rotational movement to the well string, a feeder for supplying a pumpable substance such as cement and the like from an external supply source to the interior of the well string in the well bore without first discharging it through the top drive power unit including a body having flow passages for communicating the pumpable substance from an external source to discharge through the sub and into the interior of the well string below the top drive power unit, and a brace which reduces and/or eliminates the transfer of forces from the chicksan line to the valve and inlet of the side entry sub.

9 Claims, 25 Drawing Sheets

PRE-MADE UP SIDE ENTRY SUB APPARATUS AND METHOD

CROSS-REFERENCE TO RELATED APPLICATIONS

Priority of U.S. Provisional Patent Application Ser. No. 61/025,969, filed Feb. 4, 2008, incorporated herein by reference, is hereby claimed.

REFERENCE TO A "MICROFICHE APPENDIX"

Not applicable

BACKGROUND

In top drive rigs, the use of a top drive unit, or top drive power unit is employed to rotate and/or reciprocate drill pipe, or well string in a well bore. Top drive rigs can include spaced guide rails and a drive frame movable along the guide rails and guiding the top drive power unit. The travelling block supports the drive frame through a hook and swivel, and the driving block is used to lower or raise the drive frame along the guide rails.

During drilling operations, when it is desired to "trip" the drill pipe or well string into or out of the well bore, the drive frame can be lowered or raised. Additionally, during servicing operations, the drill string can be moved longitudinally into or out of the well bore.

The stem of the side entry sub communicates with the upper end of the member of the power unit in a manner well known to those skilled in the art for supplying fluid, such as a drilling fluid or mud, through the top drive unit and into the drill or work string. The side entry sub allows fluid to pass through and be supplied to the drill or well string connected to the lower end of the member of the top drive power unit as the drill string is moved up and down.

Top drive rigs also can include elevators that are secured to and suspended from the frame, the elevators being employed when it is desired to lower joints of drill string into the well bore, or remove such joints from the well bore.

At various times top drive operations, beyond drilling fluid, require various substances to be pumped downhole, such as cement, chemicals, epoxy resins, or the like. In many cases it is desirable to supply such substances at the same time as the top drive unit is moving the drill or well string up and/or down, but bypassing the top drive's power unit so that the substances do not damage/impair the unit. Additionally, it is desirable to supply such substances without interfering with and/or intermittently stopping longitudinal movement by the top drive unit of the drill or well string.

A need exists for a device facilitating insertion of various substances downhole through the drill or well string, bypassing the top drive unit, while at the same time allowing the top drive unit to longitudinaly move the drill or well string.

One example includes cementing a string of well bore casing. In some casing operations it is considered good practice to move up and down the string of casing when it is being cemented in the wellbore. Such movement is believed to facilitate better cement distribution and spread inside the annular space between the casing's exterior and interior of the well bore. In such operations the top drive unit can be used to both support and continuously/intermittently reciprocate the string of casing while cement is pumped down the string's interior. During this time it is desirable to by-pass the top drive unit to avoid possible damage to any of its portions or components.

The following U.S. Patents are incorporated herein by reference: U.S. Pat. No. 4,722,389.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment is provided a top drive arrangement for longitudinally moving a drill or well string.

In one embodiment is provided a side entry sub especially useful for top drive rigs.

In one embodiment is provided a side entry sub having a brace which can substantially reduce, minimize, and/or eliminate the transfer of loading from a side inlet located outside of the brace to the side inlet of the sub.

In one embodiment, the side entry sub with brace is marketed pre-made up with a valve located on the interior of the brace.

In one embodiment is provided a method of raising and lowering a chicksan line supported by a side entry sub without also supporting the chicksan line with a tugger line.

In one embodiment the chicksan line is supported by an inlet to the side entry sub which is located exterior to a brace, the inlet being supported by the brace.

In one embodiment the chicksan line is supported by a brace along with an inlet to the side entry sub which is located exterior to a brace, the inlet being supported by the brace.

In one embodiment is provided a method of raising and lowering a chicksan line supported by a side entry sub without also having an individual charged with maintaining the height of the chicksan line relative to the height of the side entry sub.

In one embodiment the brace and side entry inlet located exterior to the brace include a pressure lock system whereby longitudinal movement of the inlet is locked which such inlet is pressurized.

In one embodiment is provide a side entry sub having a counterweight to compensate for the weight of a pre-made up side entry sub with brace.

In one embodiment the counterweight is detachable.

In one embodiment the counterweight is adjustable.

In one embodiment is provided a side entry sub that can be incorporated into a drill or well string and enabling string sections both above and below the sub to be reciprocated while providing a flow path between the exterior of the sub and interior of the drill string while the drill string is being moved in a longitudinal direction (up or down). The interior of the side entry sub can be fluidly connected to the longitudinal bore of casing or drill string thus providing a path from the side entry inlet to the interior of the casing/drill string.

In one embodiment is provided a method and apparatus for servicing a well wherein a side entry sub is connected to and below a top drive unit for conveying pumpable substances from an external supply through the side entry sub for discharge into the well string, but bypassing the top drive unit.

In one embodiment is provided a method of conducting servicing operations in a well bore, such as cementing, comprising the steps of moving a top drive unit longitudinally to provide longitudinal movement in the well bore of a well string suspended from the top drive unit, and supplying a pumpable substance to the well bore in which the drill or well string is manipulated by introducing the pumpable substance at a point below the top drive power unit and into the well string.

In other embodiments a side entry sub is placed below the top drive unit and can be used to perform jobs such as spotting pills, squeeze work, open formation integrity work, kill jobs, fishing tool operations with high pressure pumps, sub-sea stack testing, reciprocation of casing during side tracking, and gravel pack or frack jobs. In still other embodiments a side entry sub can be used in a method of pumping loss circulation material (LCM) into a well to plug/seal areas of downhole fluid loss to the formation and in high speed milling jobs using cutting tools to address down hole obstructions. In other embodiments the side entry sub can be used with free point indicators and shot string or cord to free stuck pipe where pumpable substances are pumped downhole at the same time the downhole string/pipe/free point indicator is being rotated and/or reciprocated. In still other embodiments the side entry sub can be used for setting hook wall packers and washing sand.

In still other embodiments the side entry sub can be used for pumping pumpable substances downhole when repairs/servicing is being done to the top drive unit and reciprocation of the downhole drill string is being accomplished by the top drive unit. Such use for reciprocation and pumping can prevent sticking/seizing of the drill string downhole.

In still other embodiments safety valves, such as TIW valves, can be placed above and below the side entry sub to enable routing of fluid flow and to ensure well control.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
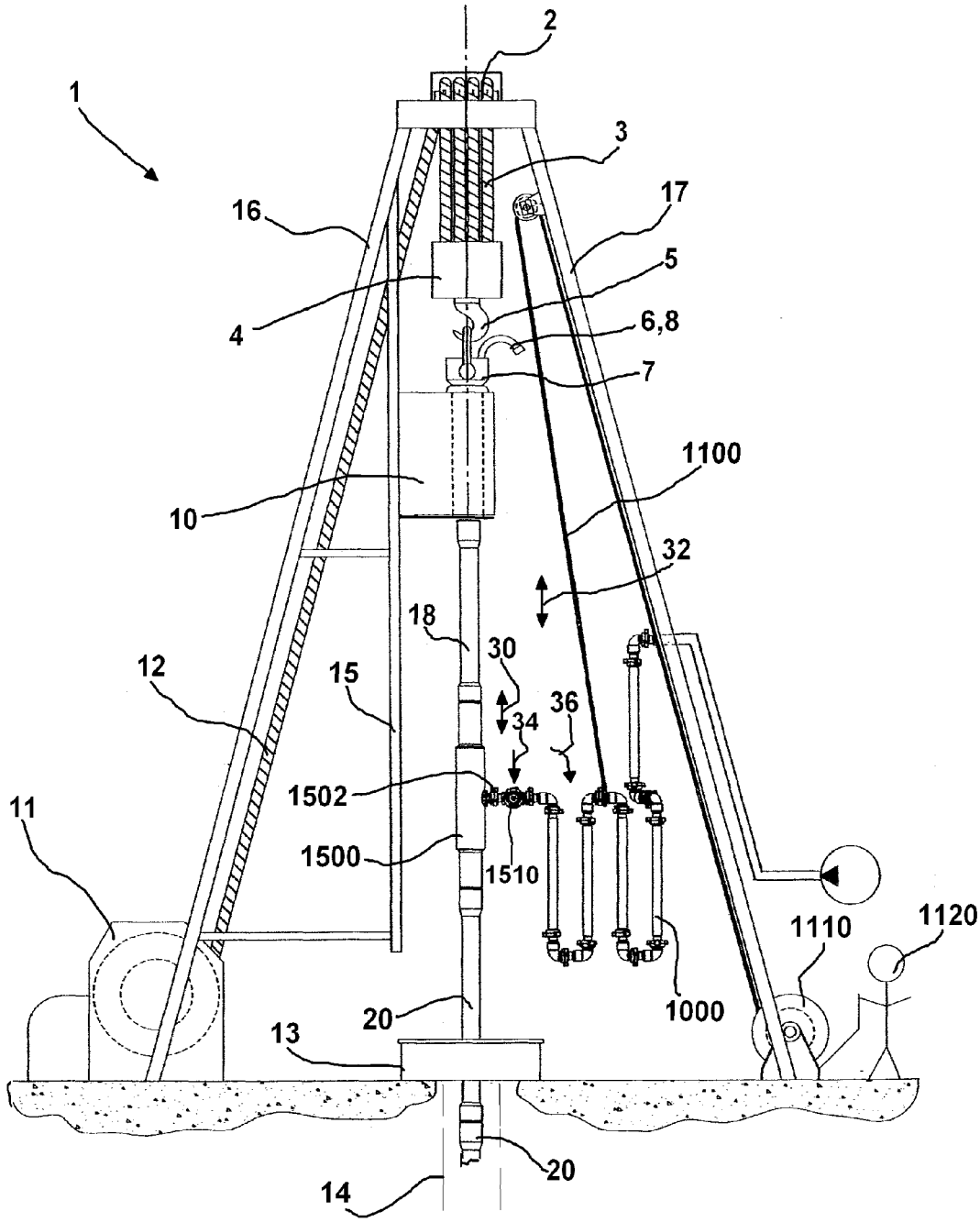
FIG. 1 PRIOR ART
FIG. 1 is a schematic view showing a top drive rig with a side entry sub and chicksan line, wherein the chicksan line is being supported by a tugger line.

FIG. 1 PRIOR ART is a schematic view showing a top drive rig 1 with a prior art side entry sub 1500 incorporated into drill string 20. FIG. 1 PRIOR ART is shows a rig 1 having a top drive unit 10. Rig 1 comprises supports 16,17; crown block 2; traveling block 4; and hook 5. Draw works 11 uses cable 12 to move up and down traveling block 4, top drive unit 10, and drill string 20. Traveling block 4 supports top drive unit 10. Top drive unit 10 supports drill string 20.

During drilling operations, top drive unit 10 can be used to rotate and/or reciprocate drill string 20 which enters wellbore 14. Top drive unit 10 can ride along guide rails 15 as unit 10 is moved up and down. Guide rails 15 prevent top drive unit 10 itself from rotating as top drive unit 10 rotates drill string 20. During drilling operations drilling fluid can be supplied downhole through drilling fluid line 8 and gooseneck 6.

At various times top drive operations, beyond drilling fluid, require substances to be pumped downhole, such as cement, chemicals, epoxy resins, or the like using a chicksan line 1000. In many cases it is desirable to supply such substances at the same time as top drive unit 10 is moving drill or well string 20 up and/or down (schematically shown by arrows 30 in FIG. 1) and bypassing top drive unit 10 so that the substances do not damage/impair top drive unit 10. Additionally, it is desirable to supply such substances without interfering with and/or intermittently stopping longitudinal movements of drill or well string 20 being moved by top drive unit 10. This can be accomplished by using side entry sub 1500 fluidly connected to chicksan line 1000. However, a problem and/or disadvantage of using side entry sub 1500 because the weight of chicksan line 1000 (which can weight several hundred or thousands of pounds), can place a load on inlet 1502 along with valve 1510 and their connections. The load, which can be vertical and bending is schematically indicated by arrows 34 and 36 in FIG. 1. This load can cause failure of the connections and/or seizure of valve 1510. To address this load, a tugger line 1100 is used to support the weight of chicksan line 1000.

However, as top drive 10 moves drill or well string 20 (and side entry sub 1500) in the direction of arrows 30, tugger line 1100 is also moved in the direction of arrows 32 to track the movement of sub 1500 and minimize loading (such as that schematically shown by arrows 34 and 36). To accomplish this tracking movement of chicksan line 1000 an operator 1120 can be dedicated to operate tugger line 1100 using winch 1110. However, operator 1120 is human and this creates that risk that human error will cause loading such as where operator 1120 does not correctly track the movement of sub 1500 thereby creating loading on sub 1500 and associated loading (schematically indicated by arrows 34, 36). Beyond increasing the manpower necessary to operate the rig (by dedicating operator 1120), this manual tracking creates the risk of loading and failure of sub 1500.

Figure 2A:
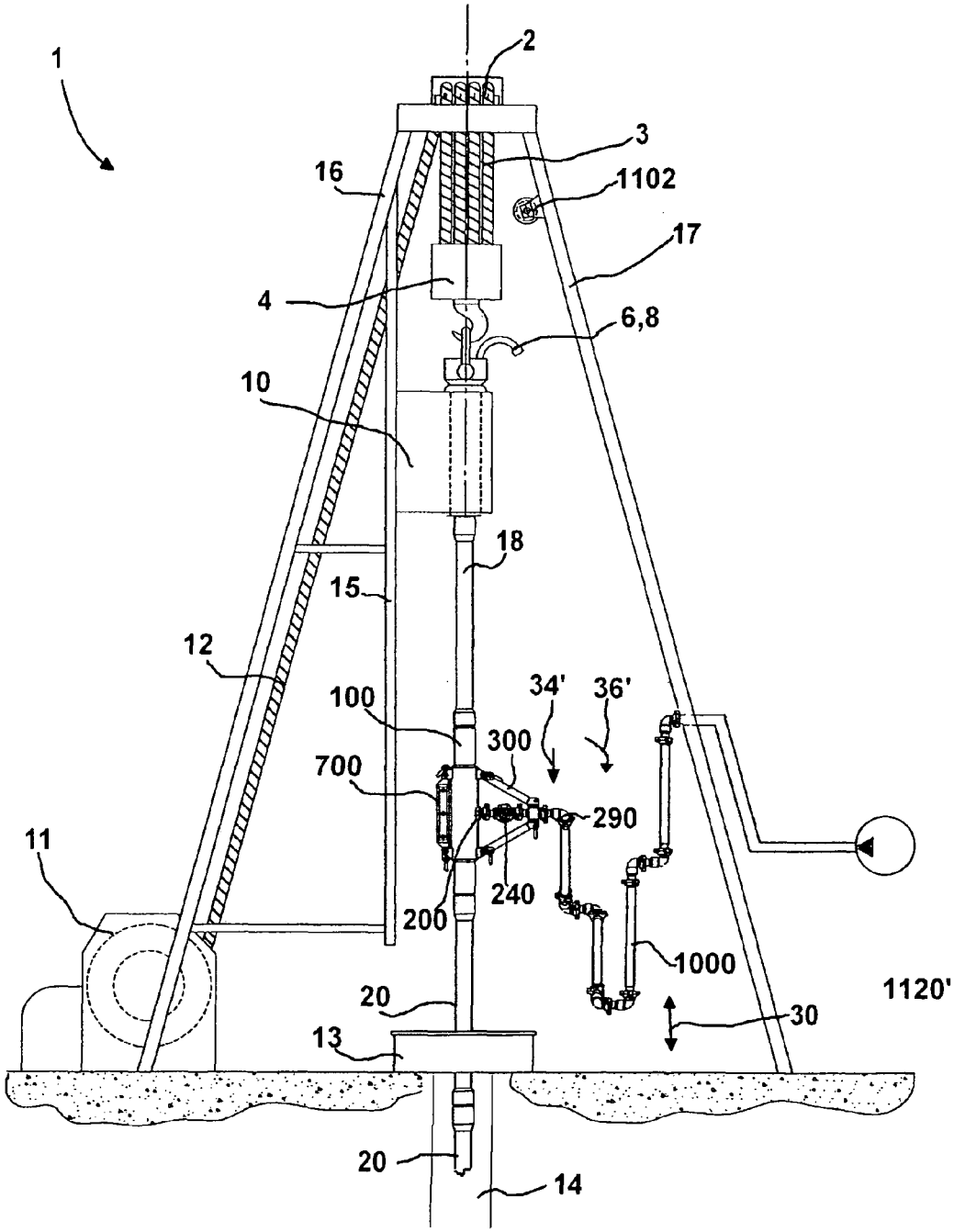
FIG. 2A is a schematic view showing one embodiment of a side entry sub independently supporting the chicksan line.

FIG. 2A shows one embodiment where side entry sub 100 can be used with brace 300 to support chicksan line 1000 without the use of operator 1120 and/or tugger line 1100. In this embodiment loading from chicksan line 1000 (schematically indicated by arrows 34 and 36 in FIG. 1) on inlet 200 of side entry sub 100 and/or on valve 240 is minimized or eliminated by being located on the interior of brace 300. With this embodiment, the loading (schematically indicated by arrows 34' and 36') is absorbed by brace 300 and transmitted to body 110 of side entry sub 100 so that valve 240 and inlet 200 do not see a significant amount of loading (if any) from the chicksan line 1000 thereby minimizing the risk of failure and also avoiding the need for an operator 1120 with tugger line 1100 independently supporting the chicksan line 1000. The body 110 of side entry sub 100 transmits this loading to the drill or well string 20, which transmits it to the rig 1 without risking failure of valve 240 or inlet 200 (or the connections located inside of brace 300).

Figure 2B:
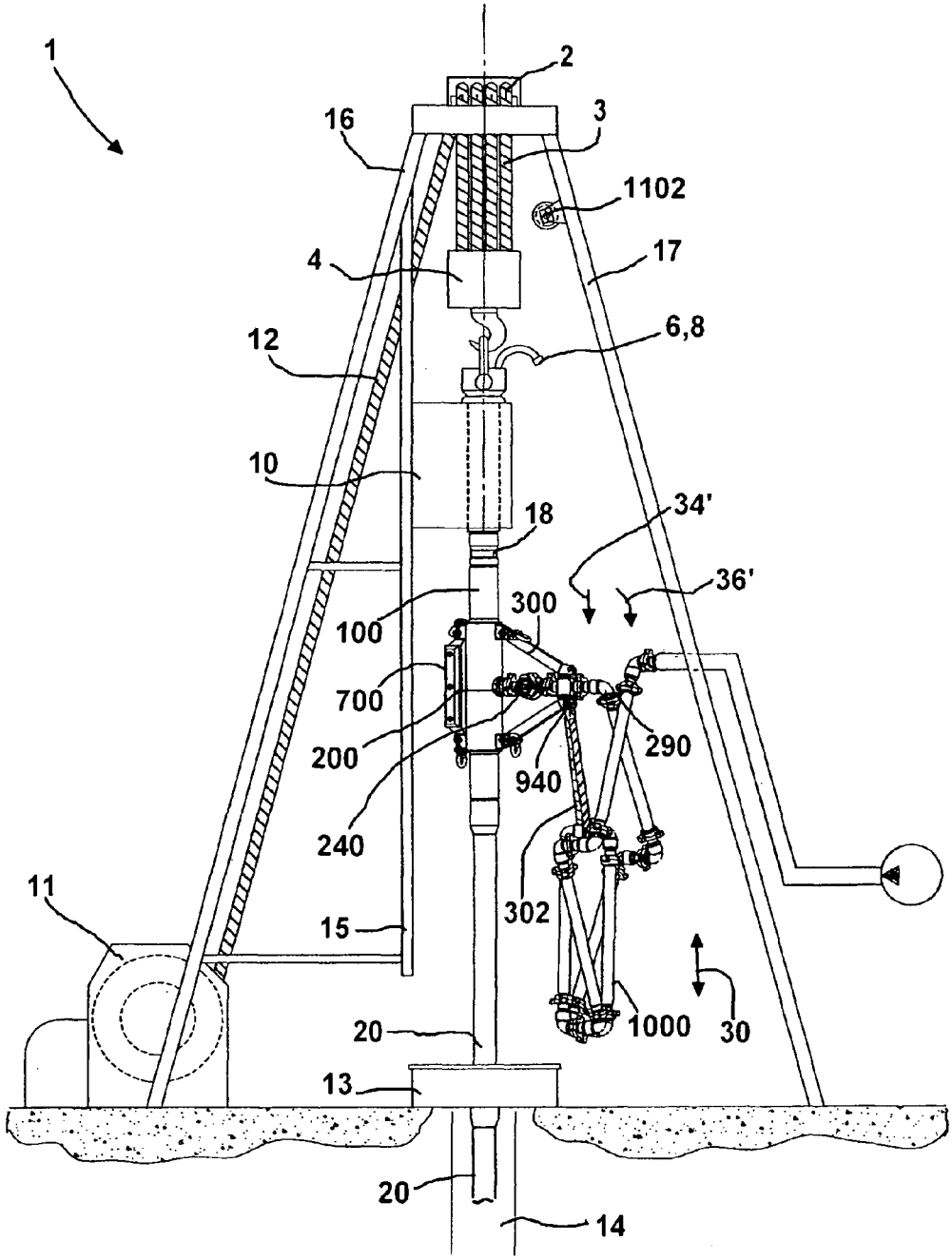
FIG. 2B is a schematic view showing the side entry sub of FIG. 2A supporting the chicksan line at the inlet to the side entry sub, along with a redundant line being used to support the chicksan line from a different point than the inlet of the side entry sub.

In one embodiment shown in FIG. 2B an auxiliary support line 302 can also be used to support chicksan line 1000. Although inlet 290 is designed so that it can independently support chicksan line 1000, auxiliary support line 302 can provide a redundant support for chicksan line 1000. Auxiliary support line 302 is shown in FIG. 2B connected to shackle 940. Alternatively, auxiliary support lines can be connected to other places on side entry sub 100, such as shackle 920 (or shackle 900, 910, or 930). Also alternatively, although not shown, a plurality of auxiliary support lines 302, 302', 302", etc. can be used to support chicksan line 1000 at multiple locations on side entry sub 100 and/or brace 300.

Side entry sub 100 can be installed between top drive unit 10 and drill string 20. One or more joints of drill pipe 18 can be placed between top drive unit 10 and side entry sub 100. Additionally, a valve can be placed between side entry sub 100 and top drive unit 10. Pumpable substances can be pumped through chicksan line 1000, and into the interior of drill string 20 thereby bypassing top drive unit 10. Side entry sub 100 is preferably sized to be connected to drill string 20 such as 4½ inch IF API drill pipe or the size of the drill pipe to which sub 30 is connected to. However, cross-over subs can also be used between side entry sub 100 and connections to drill string 20.

Figure 3:
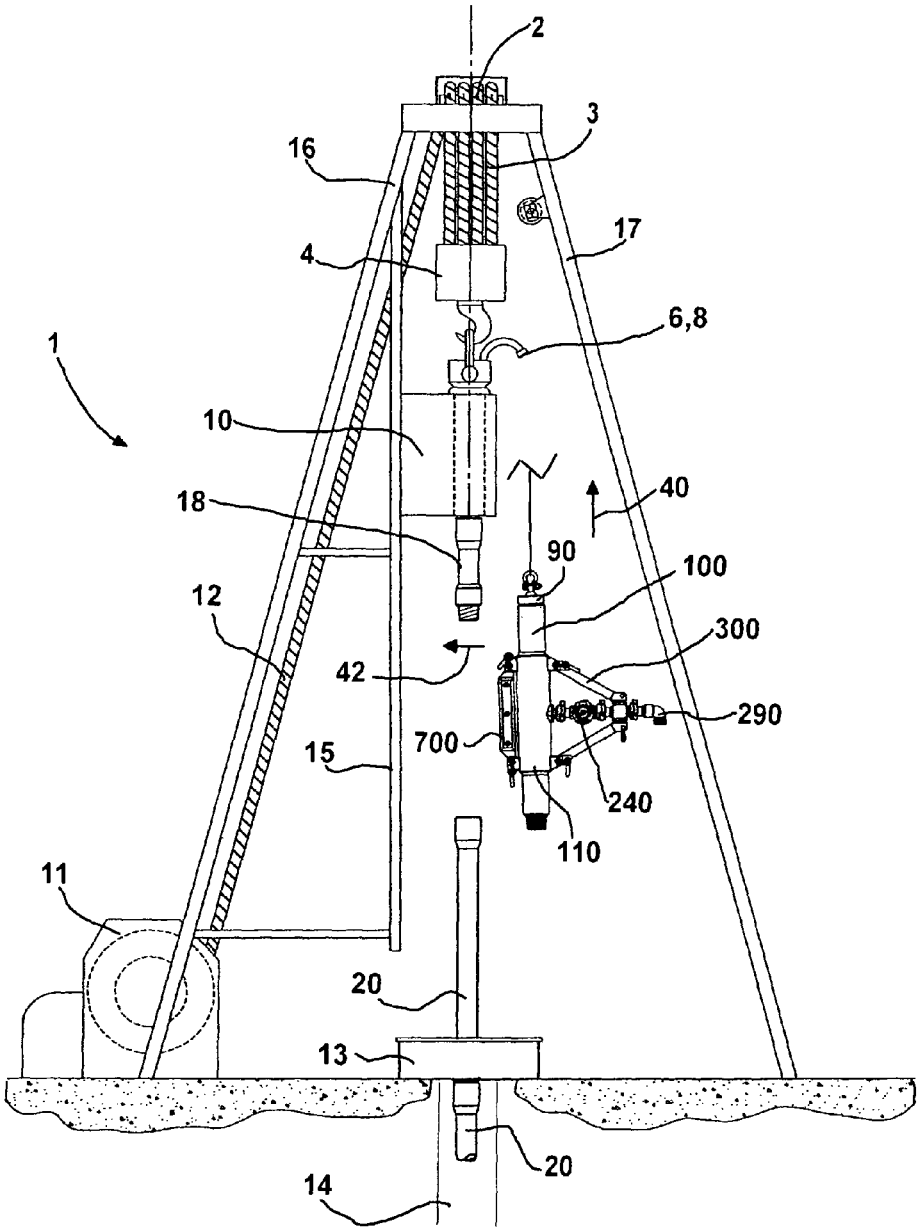
FIG. 3 is a schematic view showing one embodiment of the side entry sub of FIG. 2 being moved into position in the drill string.

FIG. 3 is a schematic view showing one embodiment of side entry sub 100 being moved into position (schematically indicated by arrow 42) in drill string 20. Here, a lifting sub 90 is used to lift side entry sub 100. Additionally, a preferred embodiment of side entry sub 100 includes counterweight 700 to substantially place the longitudinal center of gravity of side entry sub 100 close to the longitudinal centerline CL of body 110 (see e.g., FIG. 6). Such placement of the longitudinal center of gravity helps keep side entry sub 100 substantially vertical before it is stabbed into drill or well string 20 as schematically indicated by FIG. 3.

Figure 4:
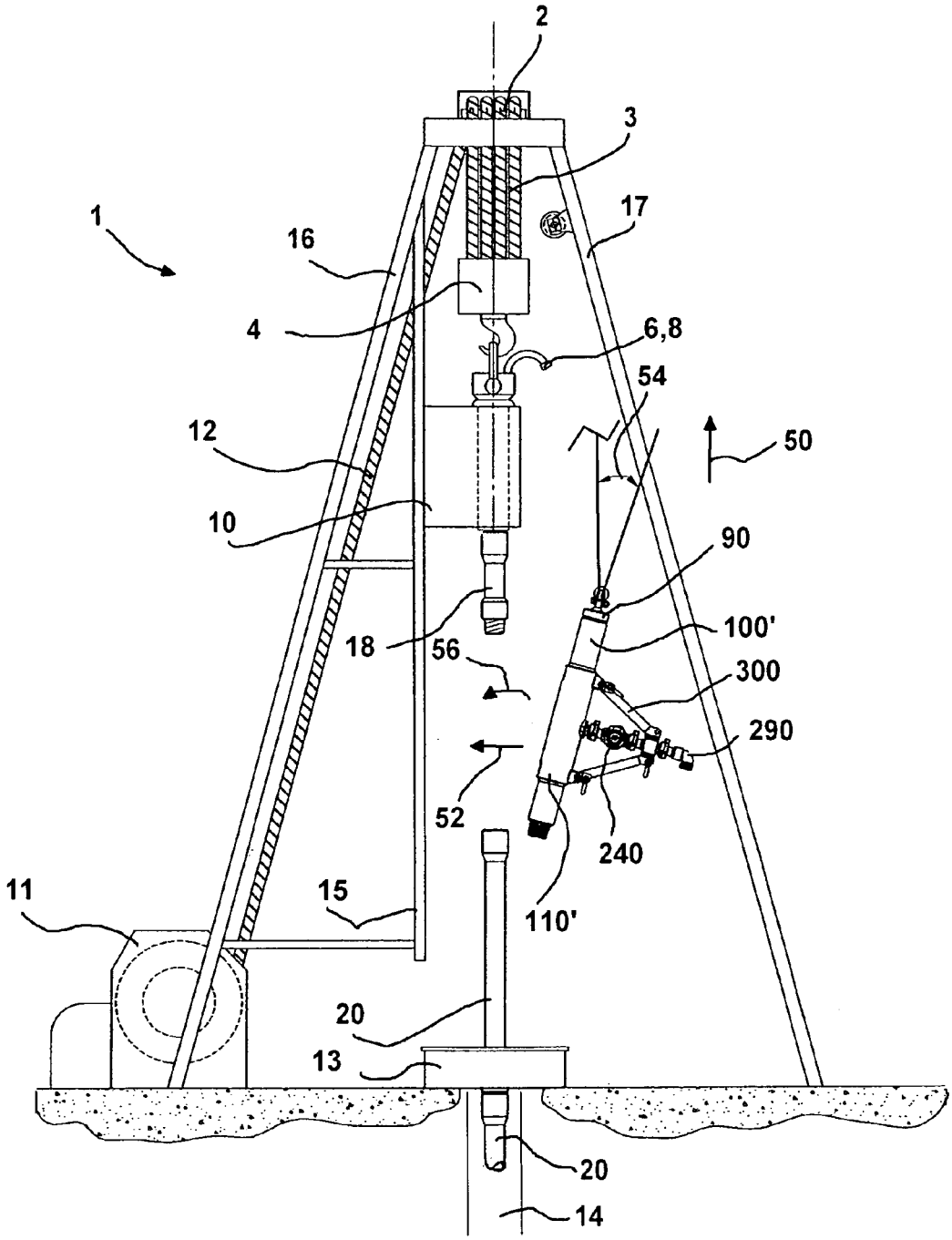
FIG. 4 is a schematic view showing an alternative embodiment of a side entry sub being moved into position in the drill string.

FIG. 4 is a schematic view showing an alternative embodiment of a side entry sub 100' is being moved into position in drill or well string 20. Here, the weight of brace 300 and valve assembly 240 causes the longitudinal center of gravity of side entry sub 100' to be substantially offset from the longitudinal centerline CL of body 110'. Such offset causes side entry sub 100' to move at an angle 54 (as schematically indicated in FIG. 4). Accordingly, to stab side entry sub 100' into drill or well string 20 it will have to be moved vertically (arrow 50), horizontally (arrow 52), and rotated in the direction of arrow 56. Such rotation in the direction of arrow 56 increases the difficulty of stabbing in side entry sub 100' along with the risk of cross threading. Accordingly, it is preferred to use a counterweight 700 to maintain the center of gravity so that no rotational movement is required when stabbing in side entry sub 100 (such as that schematically shown in FIG. 3 which minimizes or eliminates the need for rotational movement).

Figure 5:
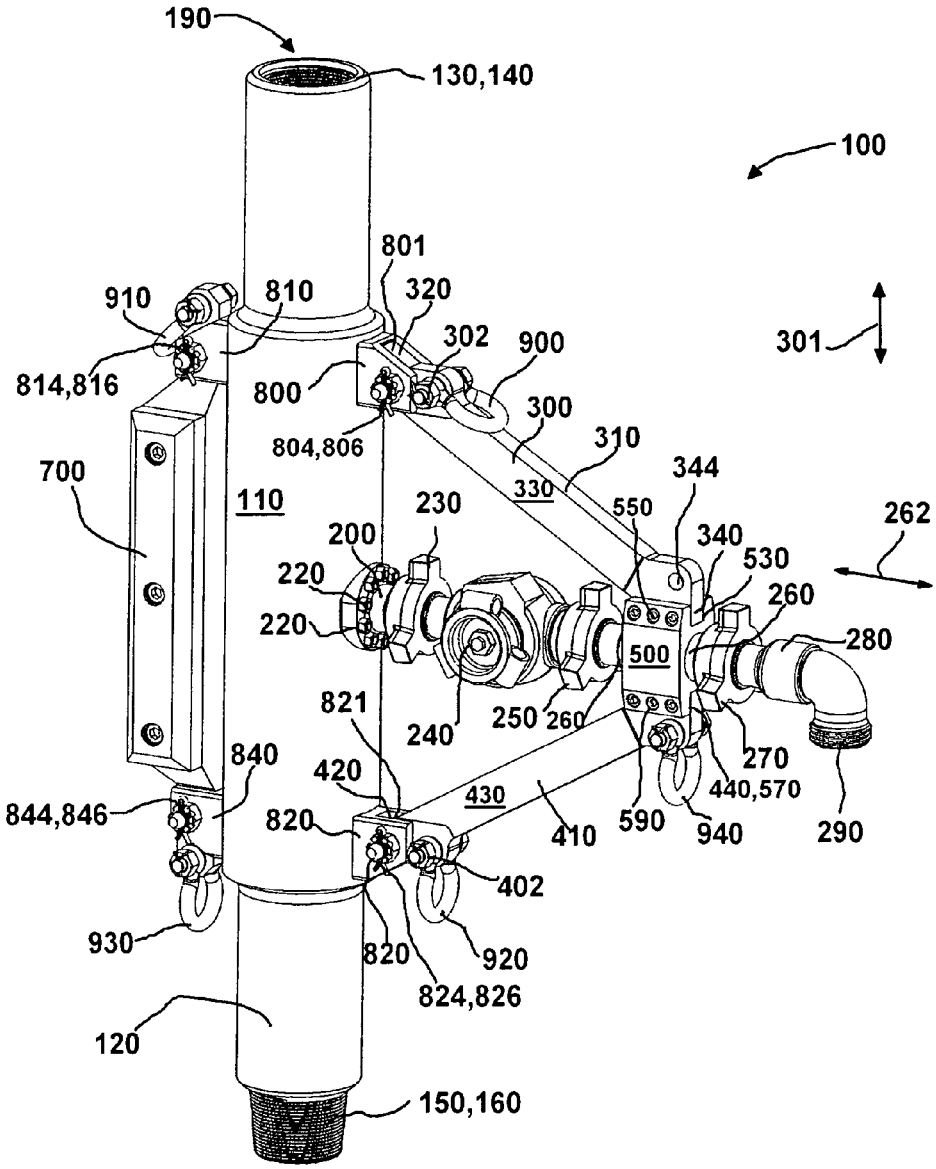
FIG. 5 is an overall perspective view of one embodiment of a side entry sub.
Figure 6:
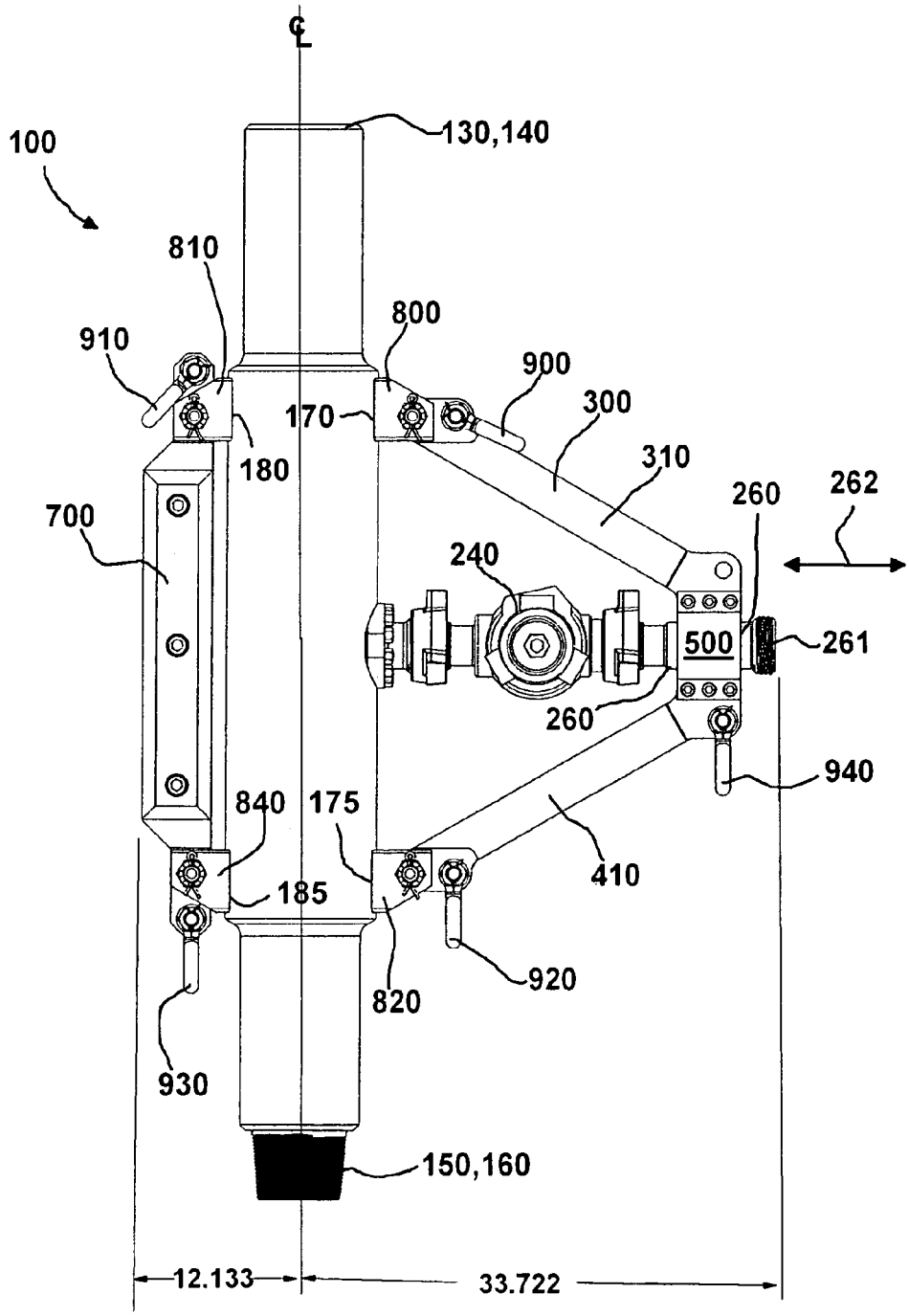
FIG. 6 is a side view of the side entry sub of FIG. 5.
Figure 7A:
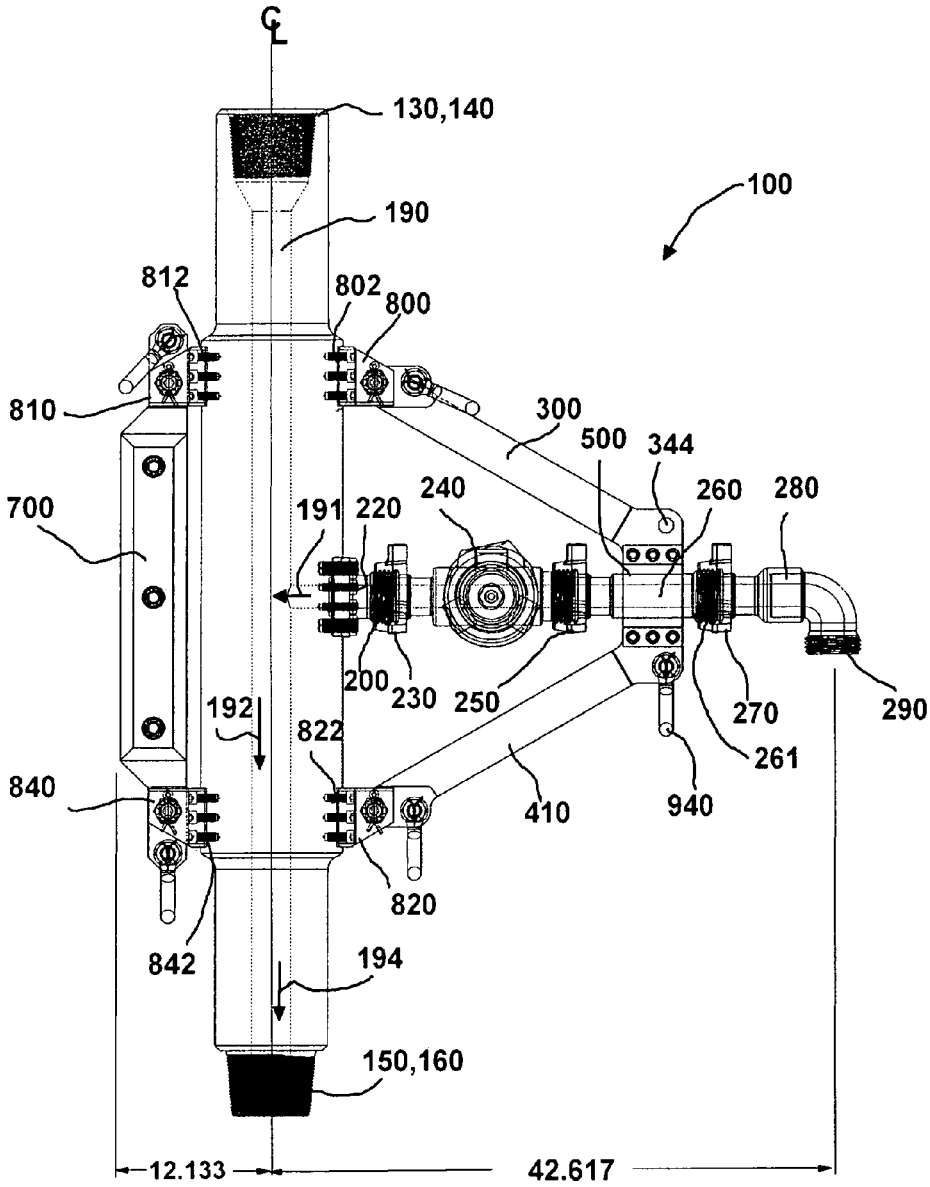
FIG. 7A is another side view of the side entry sub of FIG. 5 with a quick connect and 90 degree angle at its inlet and showing interior fluid flow.
Figure 7B:
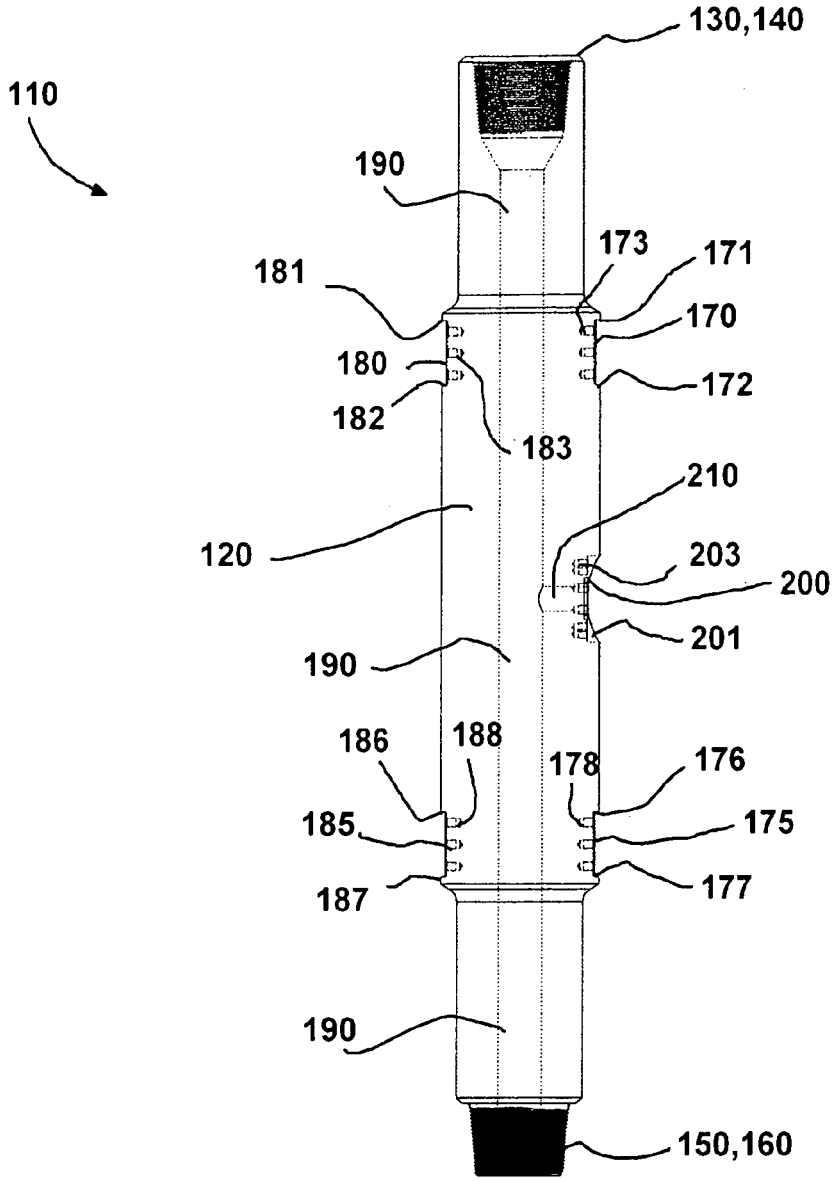
FIG. 7B is a side view of the body of the side entry sub of FIG. 7 with all components removed.
Figure 8:
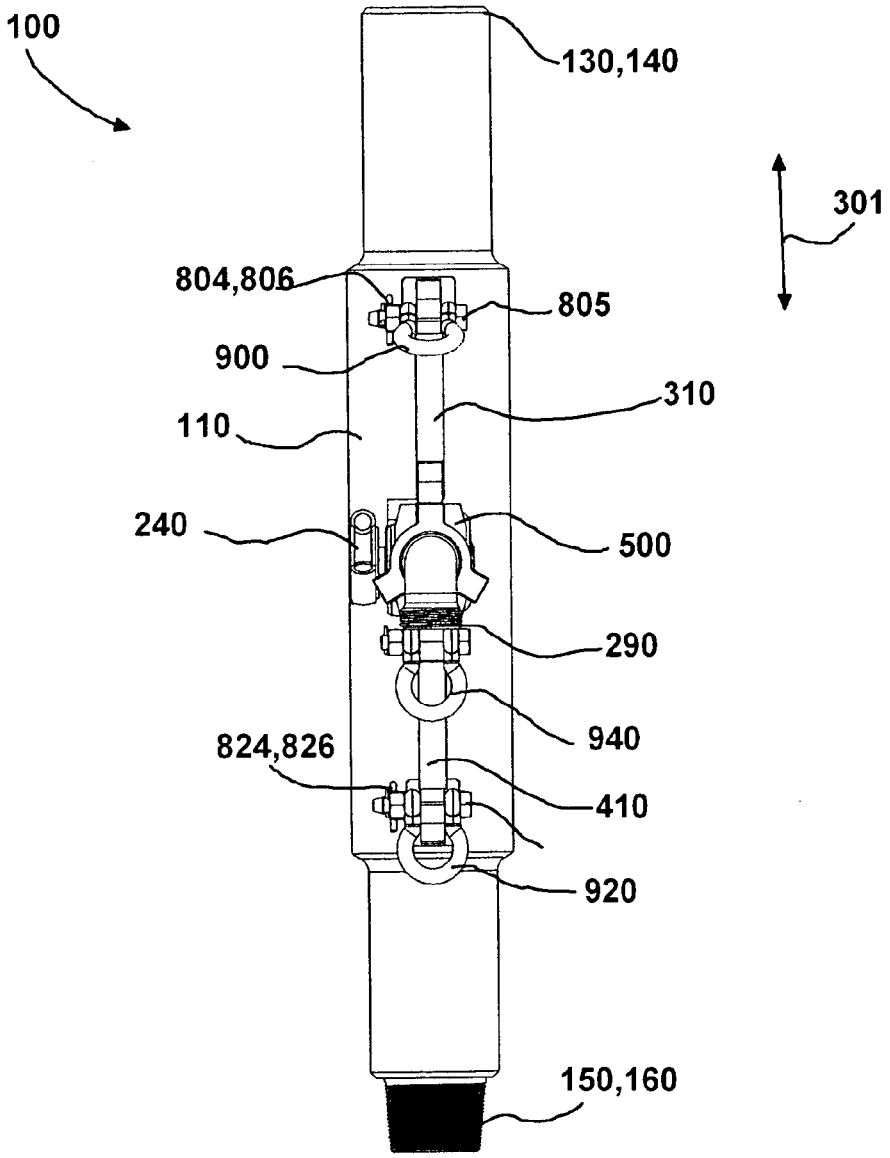
FIG. 8 is a front view of the side entry sub of FIG. 5.
Figure 9:
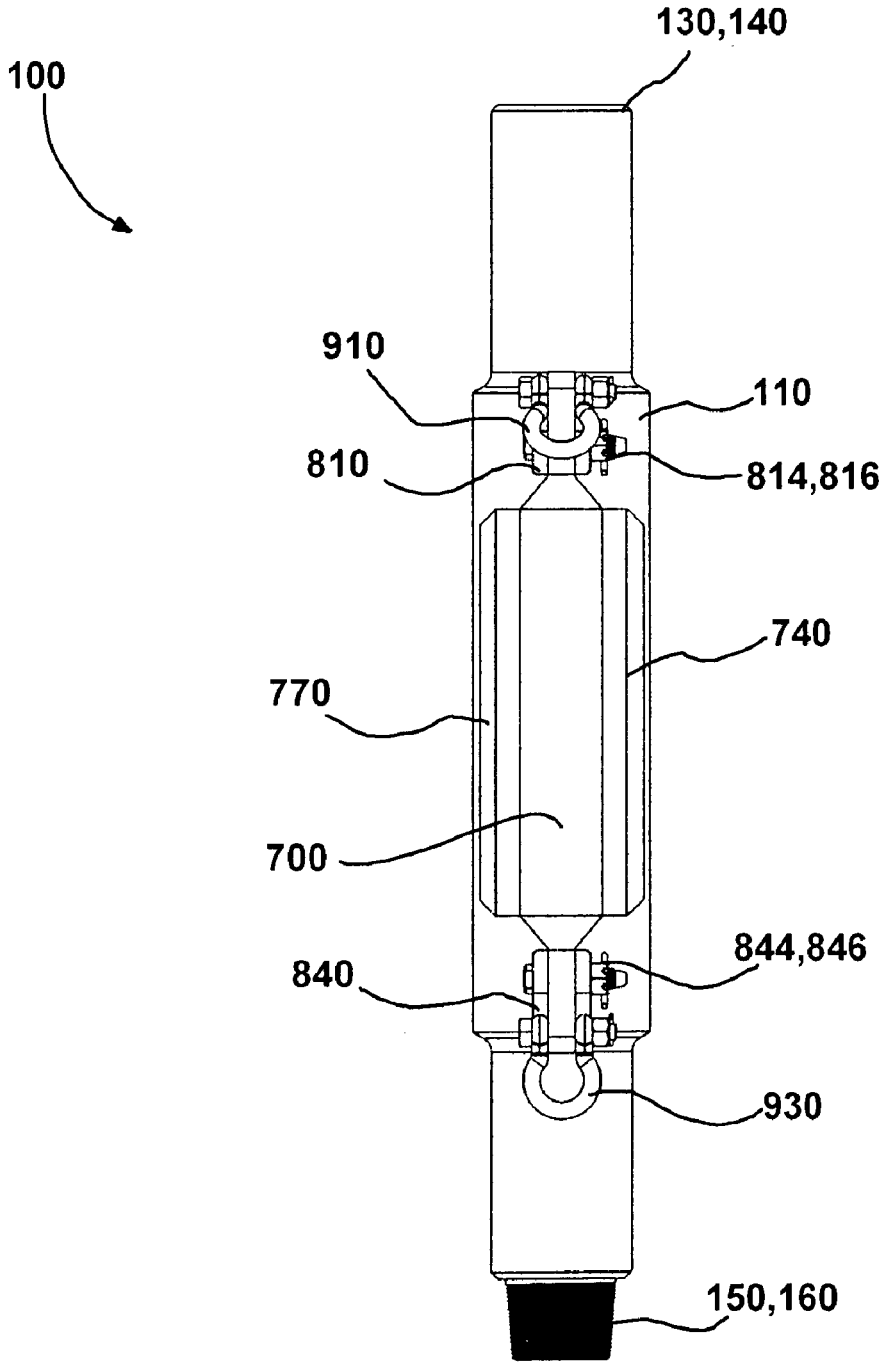
FIG. 9 is a rear view of the side entry sub of FIG. 5.
Figure 10:
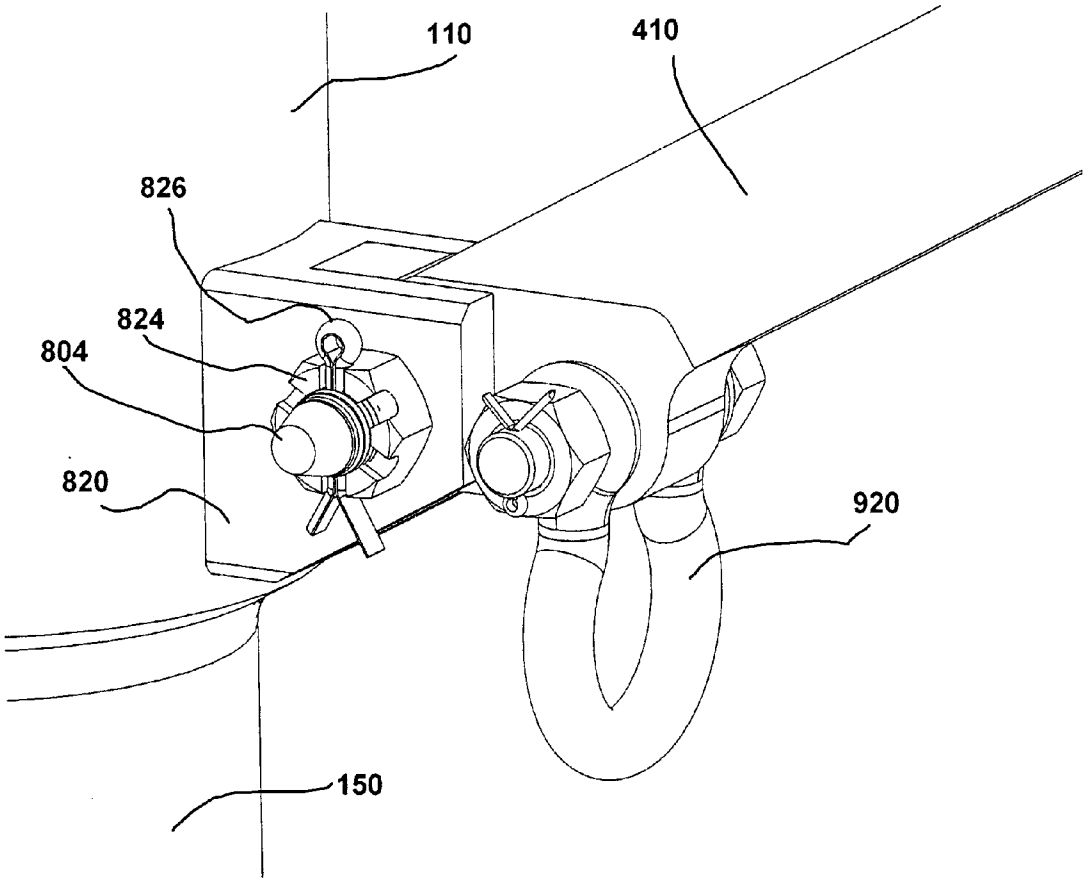
FIG. 10 is a close up view of one of the connections and eyes at the brace.

FIG. 5 is an overall perspective view of one embodiment of side entry sub 100. FIG. 6 is a side view of side entry sub 100. FIGS. 7A and 7B are side views of side entry sub 100 with quick connect 270 and 90 degree angle at its inlet 290 (located exterior to brace 300). FIG. 7B shows side entry sub body 110 with all pieces removed. FIG. 8 is a front view of side entry sub 100. FIG. 9 is a rear view of side entry sub 100. FIG. 10 is a close up view of anchor 820 and shackle 920.

Side entry sub 100 can be comprised of upper end 130 and lower end 150. Central longitudinal passage 190 extends from upper end 130 through lower end 150. Lower end 150 can include a pin connection 160 or any other conventional connection. Upper end 130 can include box connection 140 or any other conventional connection.

Side entry sub 100 can in effect become a part of drill string 20. Side entry sub 100 can include one or more radial inlet ports 210 fluidly connecting central longitudinal passage 190. Side entry sub 100 can also include inlet 200. Inlet 200 can be attached by a plurality of fasteners 220, welding, or any other conventional type method of fastening such as a threaded connection. If welded it is preferred that welds be X-ray tested, magnetic particle tested, and stress relieved.

Side entry sub 100 can include valve 240 which is fluidly connected to inlet passage 190. Side entry sub 100 can also include brace 300 which can substantially reduce, minimize, and/or eliminate bending, tensile, compressive, shear, and/or other stresses on valve 240, inlet 200, and connections for either. Brace 300 can comprise first 310 and second 410 arms which are connected to each other and side entry sub 100, and protectively surround valve 240.

Figure 11:
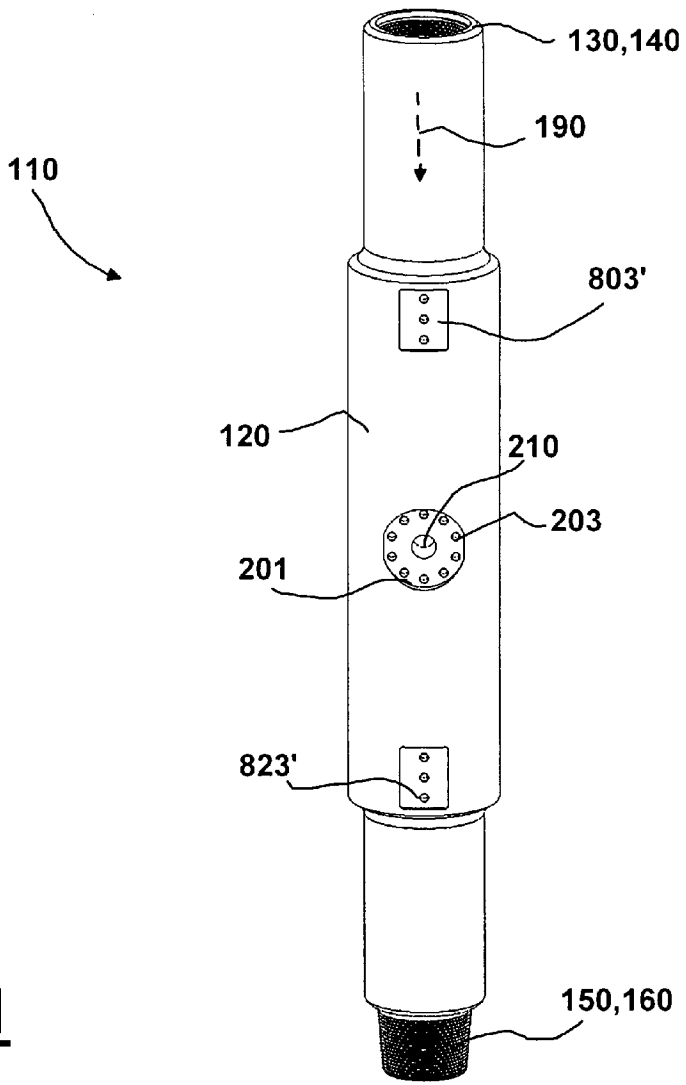
FIG. 11 is a side perspective view of the body of the side entry sub of FIG. 5 with all components removed.

FIG. 7A is a side view of side entry sub with all components (e.g., brace 300 and counterweight 700) attached. FIG. 11 is a front perspective view of body 110 of side entry sub 100 with all components removed. FIG. 7B is a side view of body 110 with all components removed. Body 110 can include upper end 130 (which can be a box connection 140)

and lower end 150 (which can be a pin connection 160). Fluidly connecting upper end 130 with lower end 150 can be central longitudinal passage 190. Between upper end 130 and lower end 150 can be enlarged area 120. Side opening 210 can be provided which fluidly connects side outlet to central longitudinal passage 190. Inlet 200 can be connected to body 110 through recessed area 201 and plurality of openings 203. Plurality of openings 203 can correspond to plurality of openings 202 for inlet 200. Recessed area 201 can be designed to absorb vertical loading between inlet 200 and body 110 to substantially reduce shearing on plurality of fasteners 220 (shown in FIG. 7A). As will be described below, opening 210 can be fluidly connected to valve 240.

As shown in FIG. 7B, body 110 can include recessed areas 170, 175, 180, 185. Each recessed area can include upper and lower shoulders (e.g., recessed area 170 includes upper and lower shoulders 171,172). Each recessed area can include a plurality of openings which correspond to a plurality of openings in an anchor (e.g., recessed area 170 includes plurality of openings 173 which correspond to plurality of openings 803 in first upper anchor 800). The upper and lower shoulders can be designed to absorb vertical loading between brace 300 and body 110 to substantially reduce shearing on plurality of fasteners (for example plurality of fasteners 802 shown in FIG. 7A).

Body 110 of side entry sub 100 takes substantially all of the structural load from drill string 20. Body 110 can be machined from a single continuous piece of heat treated steel bar stock. NC50 is preferably the API Tool Joint Designation for the box connection 140 and pin connection 160. Such tool joint designation is equivalent to and interchangeable with 4½ inch IF (Internally Flush), 5 inch XH (Extra Hole) and 5½ inch DSL (Double Stream Line) connections. Additionally, it is preferred that the box connection 140 and pin connection 160 meet the requirements of API specifications 7 and 7G for new rotary shouldered tool joint connections having 6⅝ inch outer diameter and a 2¾ inch inner diameter.

The Strength and Design Formulas of API 7G-Appendix A provides the following load carrying specification for the 4½ inch IF side entry sub 100: (a) 1,477,000 pounds tensile load at the minimum yield stress; (b) 62,000 foot-pounds torsion load at the minimum torsional yield stress; and (c) 37,200 foot-pounds recommended minimum make up torque. Body 110 can be machined from 4340 heat treated bar stock. Preferably side entry sub 100 will withstand a hydrostatic pressure test of 15,000 psi. At this pressure the stress induced in side entry sub 100 is preferably only about 24.8 percent of its material's yield strength. At a preferable working pressure of 7,500 psi, there is preferably a 10:1 structural safety factor for side entry sub 100.

The Strength and Design Formulas of API 7G-Appendix A provides the following load carrying specification for the 6⅝ inch IF side entry sub 100: (a) 3,600,000 pounds tensile load at the minimum yield stress; (b) 147,000 foot-pounds torsion load at the minimum torsional yield stress; and (c) 87,900 foot-pounds recommended minimum make up torque. Body 110 can be machined from 4340 heat treated bar stock. Preferably side entry sub 100 will withstand a hydrostatic pressure test of 15,000 psi with a factor of safety of 7:1. At a working pressure of 7,500 psi, there is preferably a 14:1 structural safety factor for side entry sub 100.

Figure 12:
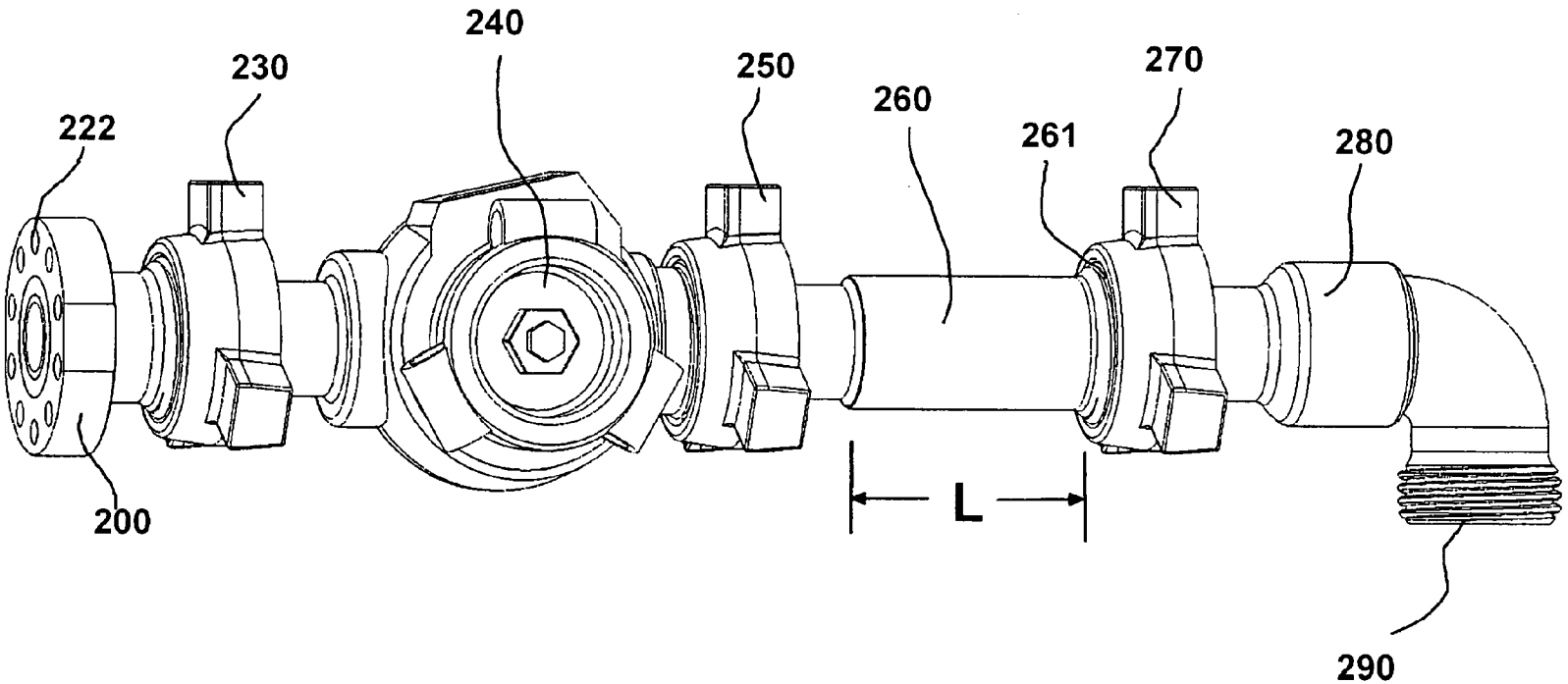
FIG. 12 is a perspective view of the valve and inlet assembly for the side entry sub of FIG. 5.

Valve 240 can be fluidly connected to side opening 122 through an inlet assembly. FIG. 12 is a perspective view of valve 240 and inlet assembly for side entry sub 100. This inlet assembly can comprise side inlet 200, quick connector 230, valve 240, quick connector 250, pipe 260, quick connector 270, swivel connection 280, and inlet 290. In alternative embodiments one or more of the quick connectors can be replaced with other types of connections, such as threaded connections, welded connections, etc. each of these components in the inlet assembly will be described below.

When not having an internal pressure, pipe 260 can slidingly connect with bracket 500 through opening 516. Pipe 260 can have an adjustable sliding length "L." This type of sliding connection allows for flexibility in the makeup of brace 300 and the inlet assembly which includes valve 240. That is, this sliding can allow for different lengths of inlet assembly between valve 240 and its connection members and bracket 500. Accordingly, the same bracket 500 and inlet connection members can be used in cases where a different size valve 240' is used. For example, if a larger valve 240' is selected, pipe 260 can slide to the right in bracket 500. If a smaller valve 240" is selected pipe 260 can slide to the left. It is preferred that the adjustable sliding length "L" of pipe 260 allows (in inches) between about ½ and 10; ½ and 9; ½ and 8; ½ and 7; ½ and 6; ½ and 5; ½ and 4; ½ and 3; ½ and 2; and ½ and 1. Alternatively, the tolerance can be between any two of the above specified ranges of sliding of pipe 260.

The sliding connection between pipe 260 and connector 500 can include a pressure lock based pipe 260 being pressurized. The tolerances between the external dimension of pipe 260 and the dimensions of opening 516 of connector 500 can be such that when a working interior pressure is applied to the interior of pipe 260, pipe 260 expands to frictionally lock with connector 500. This type of locking can be called a pressure locking between pipe 260 and opening 516. This pressure locking resists the transfer of loading placed on inlet 290 to valve 240 and/or the connections between valve 240 and body 110. Otherwise, such transmitted loading would increase the chance of a leak and/or failure in such connections and/or valve. Additionally, as described above, loading on valve 240 may increase the difficulty in opening and closing valve 240, or cause valve 240 to seize. Preferably, the tolerance between the external dimension of pipe 260 and opening 516 is (in one thousands of an inch) between about 1 and 10; 1 and 9; 1 and 8; 1 and 7; 1 and 6; 1 and 5; 1 and 4; 1 and 3; and 1 and 2. Alternatively, the tolerance can be between any two of the above specified upper limit of tolerance ranges.

Additionally, the tolerances between arms 310, 410 and the connection points of these arms are limited: (a) for arm 310—support slot 801 of first upper anchor 800 and slot 530 of connector 500 and (b) for arm 410—support slot 821 of first lower anchor 820 and slot 570 of connector 500. Preferably, the tolerance between these connecting parts is (in one thousands of an inch) between about 1 and 10; 1 and 9; 1 and 8; 1 and 7; 1 and 6; 1 and 5; 1 and 4; 1 and 3; and 1 and 2. Alternatively, the tolerance can be between any two of the above specified upper limit of tolerance ranges. Keeping the tolerances limited will minimize or prevent play (and/or wiggle) between the arms 310,410 and their connecting points; and substantially reduce or prevent the transfer of loading between inlet 290 and valve 240 and/or the connections to inlet 200 of side entry sub 100.

Figure 13:
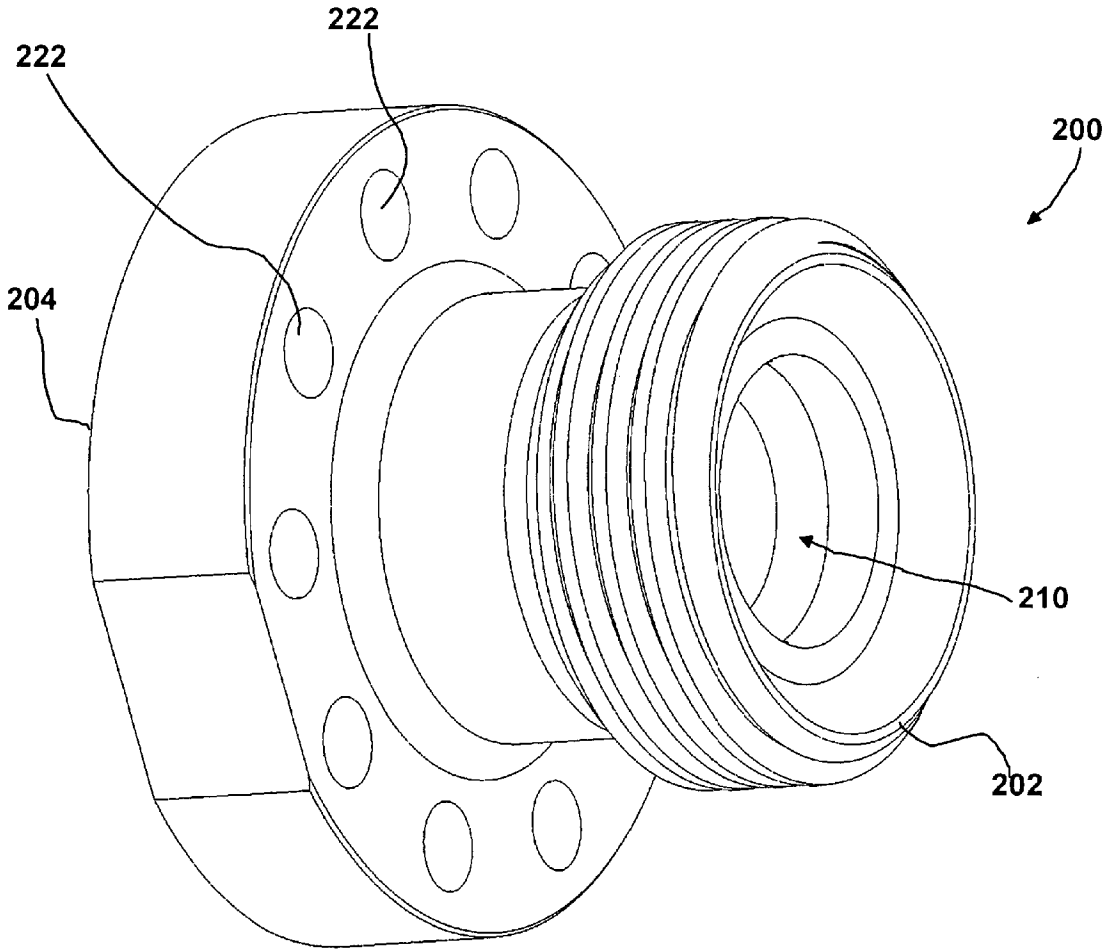
FIG. 13 is a perspective view of the body inlet for the side entry sub of FIG. 5.

FIG. 13 is a perspective view of the body inlet 200 which can comprise first end 202 (or inlet), second end 204 (or base), and passage 210 spanning from first end 202 to second end 204. First end 202 can be threaded to accept a connector such as a quick connector. Second end can include plurality of openings 222 which coincide with plurality of openings 124 on body 110 of side entry sub 100. Plurality of threaded fasteners 220 can be used to connect inlet 200 to body 110. Once connected, passage 210 becomes fluidly connected to opening 122, and to central longitudinal passage 190.

Figure 14:
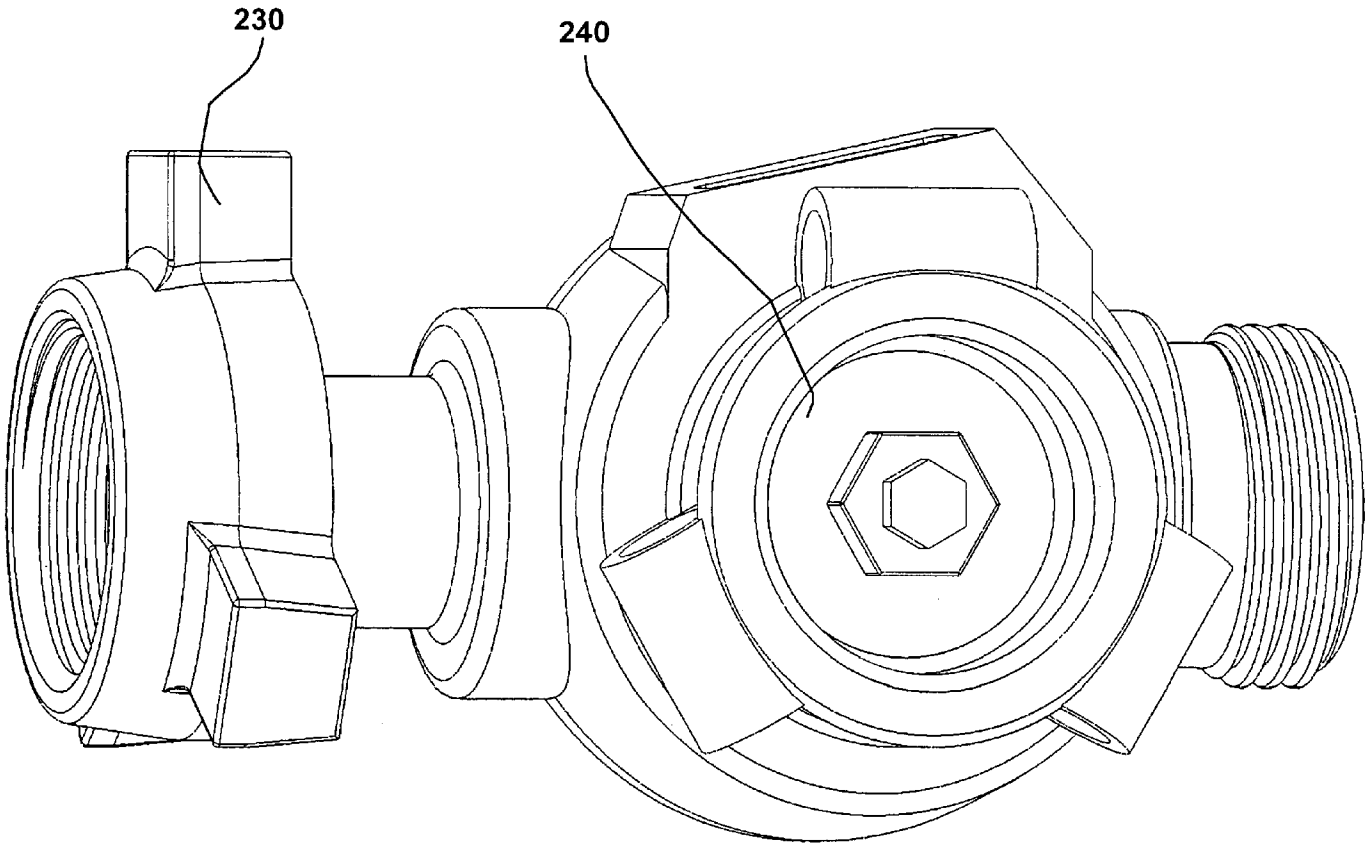
FIG. 14 is a perspective view of a valve for the side entry sub of FIG. 5.

FIG. 14 is a perspective view of a valve 240. Shown in this figure is a plug valve with quick connector both of which are conventionally available. In other embodiments other types of valves can be used such as ball, gate, butterfly, etc. Valve 240 can be manual or automatic. If automatic valve 240 can be remotely activated. Additionally, in other embodiments other types of connection can be used.

Figure 15:
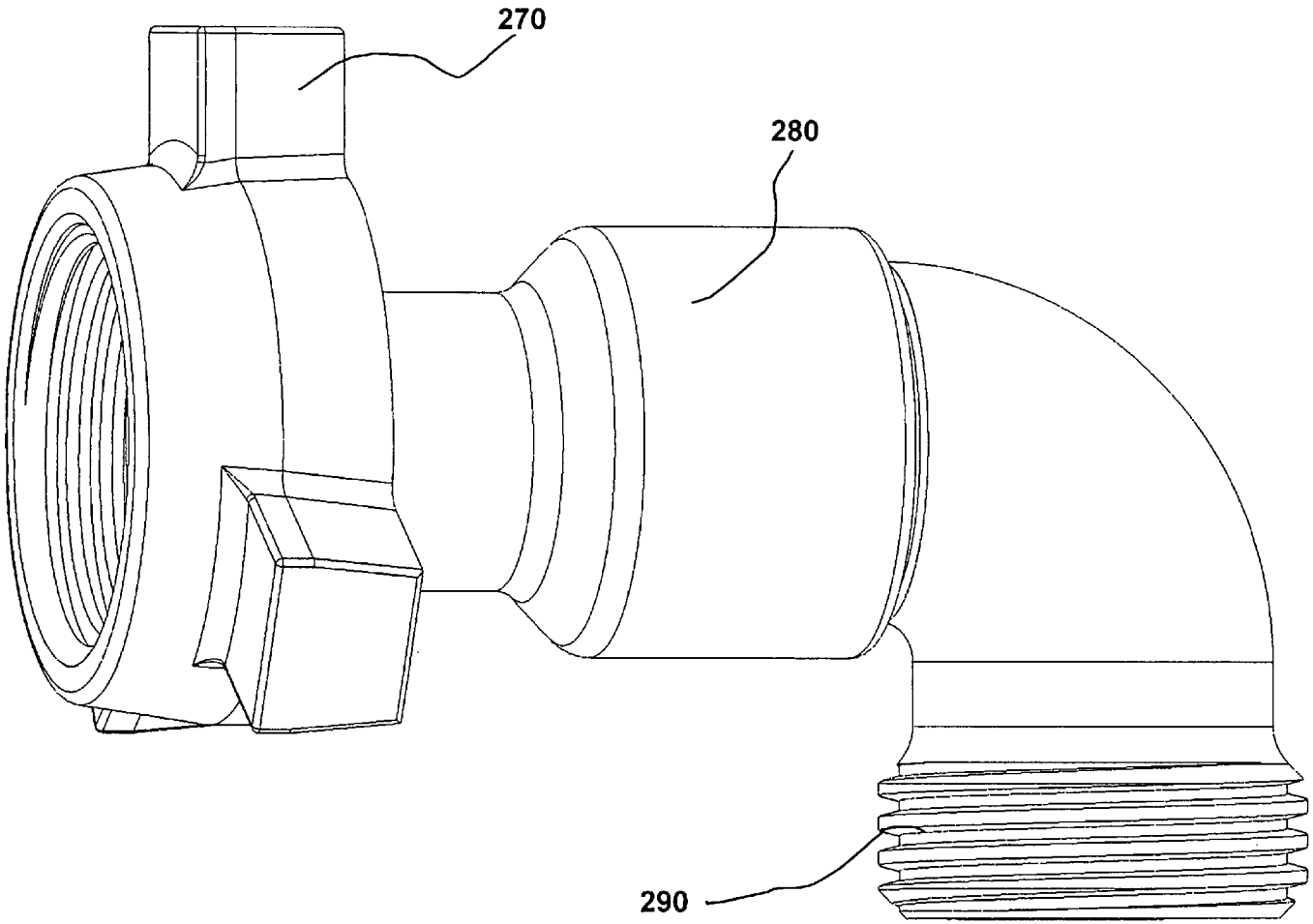
FIG. 15 is a perspective view of the inlet assembly for the side entry sub of FIG. 5.

FIG. 15 is a perspective view of the inlet assembly which can be connected to pipe 260. It can include quick connector 270, swivel connection 280, and threaded inlet 290. Each of these three items are conventionally available.

Figure 16:
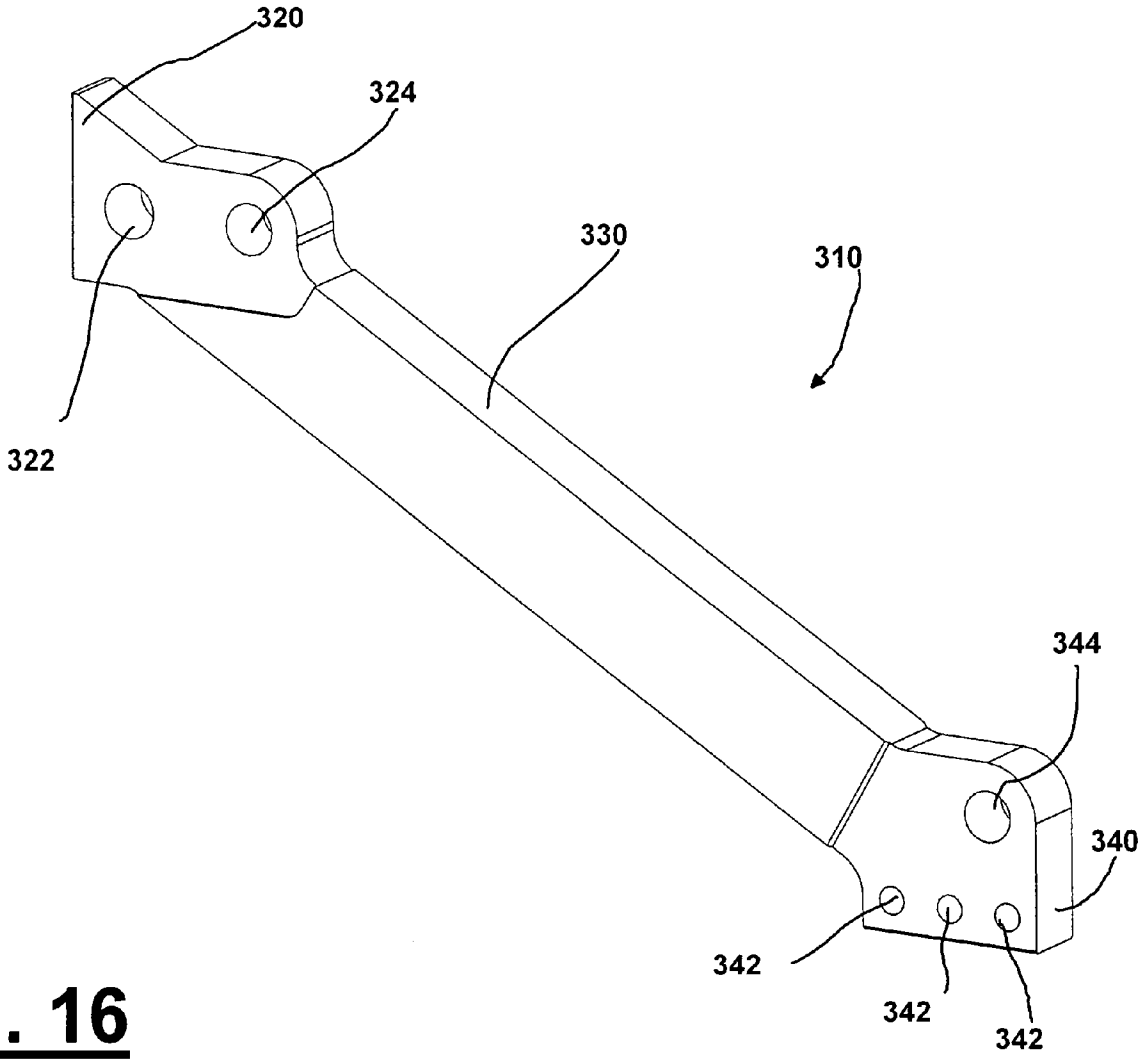
FIG. 16 is a perspective view of an arm for the side entry sub of FIG. 5.

FIG. 16 is a perspective view of an arm (e.g., first arm 310 or second arm 410). First arm 310 can comprise first end 320, second end 340, and body 330 extending there between. First end 320 can include opening 322 for connecting first end 320 to sub 100. Second end 340 can include a plurality of openings 342. First end 320 of first arm 310 can also include opening 324 which can be used to connect a shackle 900. Second end 340 of first arm 310 can also include opening 344 which can be used to connect a shackle 940 (although no shackle 940 on first arm 310 is shown in the drawings). The connection between first arm 310 and shackle 900 can be a pivoting connection. Second arm 410 can be substantially the same as first arm 310. Second arm 410 can comprise first end 420, second end 440, and body 430 extending there between. First end 420 can include opening 422 for connecting first end 420 to sub 100. Second end 440 can include a plurality of openings 442. First end 420 of second arm 410 can also include opening 424 which can be used to connect a shackle 900. Second end 440 of second arm 410 can also include opening 444 which can be used to connect a shackle 940 (shown in FIGS. 2B and 5-8). The connection between second arm 410 and shackle 920 can be a pivoting connection.

Figure 17:
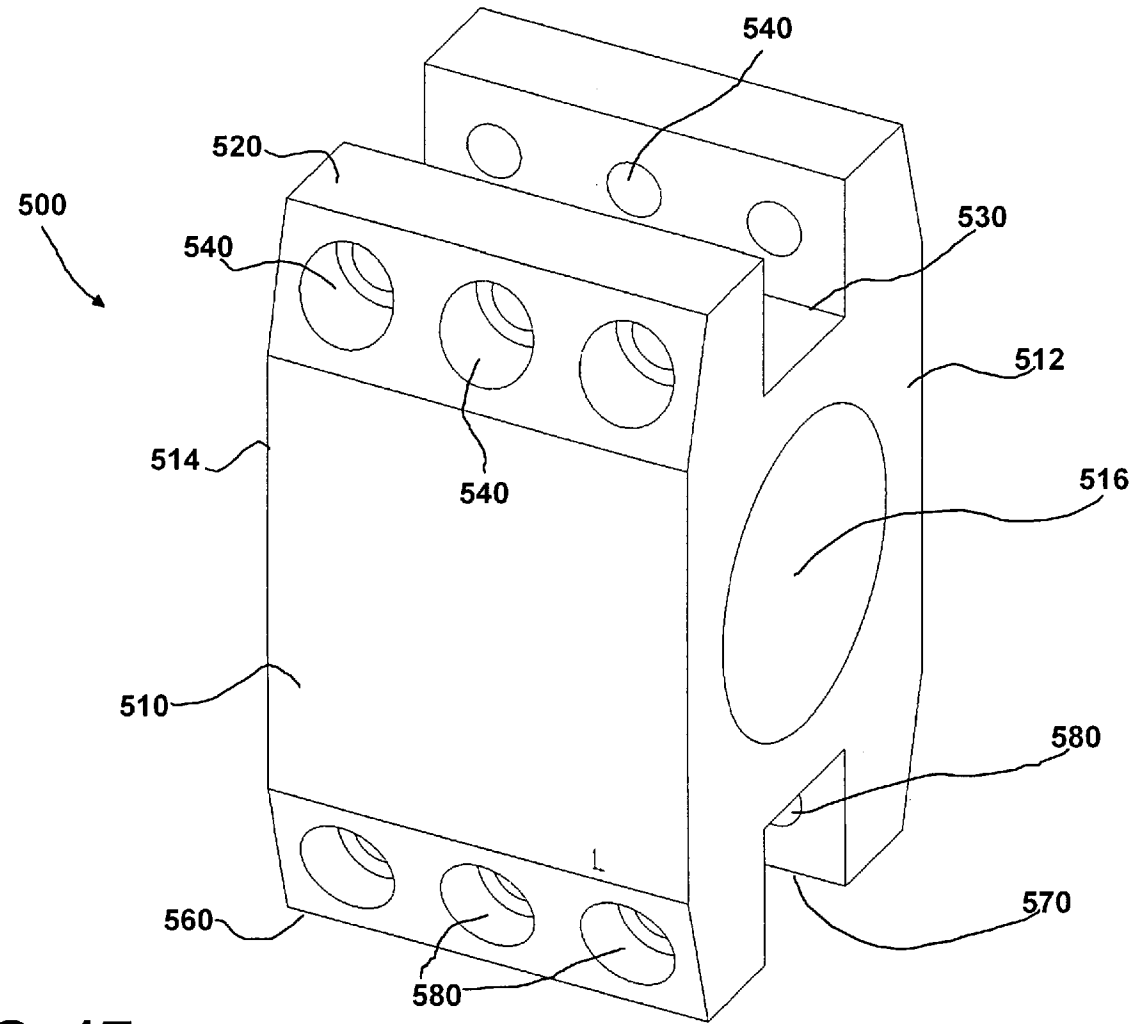
FIG. 17 is a perspective view of a connecting bracket for the side entry sub of FIG. 5.

FIG. 17 is a perspective view of a connecting bracket 500. Bracket 500 can include body 510 having first 512 and second 514 ends. Between first 512 and second 514 ends can extend opening 516, which is preferably circular in cross section. Top 520 can include slot 530 for receiving second end 340 of first arm 310. Plurality of openings 540 can be provided to coincide with plurality of openings 342 in first arm. Preferably at least one side of plurality of openings 540 can be countersunk so that threaded fasteners will not protrude from openings 540. Also preferably, the side opposite plurality of openings 540 from that being countersunk, is threaded. In this way a plurality of threaded fasteners 550 can be used to detachably connect first arm 310 with bracket 500. Bottom 560 can include slot 570 for receiving second end 440 of second arm 410. Plurality of openings 580 can be provided to coincide with plurality of openings 442 in second arm. Preferably, at least one side of plurality of openings 580 can be countersunk so that a plurality threaded fasteners will not protrude from openings 580. Also preferably, the side opposite plurality of openings 580 from that being countersunk, is threaded. In this way a plurality of threaded fasteners 590 can be used to detachably connect second arm 410 with bracket 500.

Figure 18:
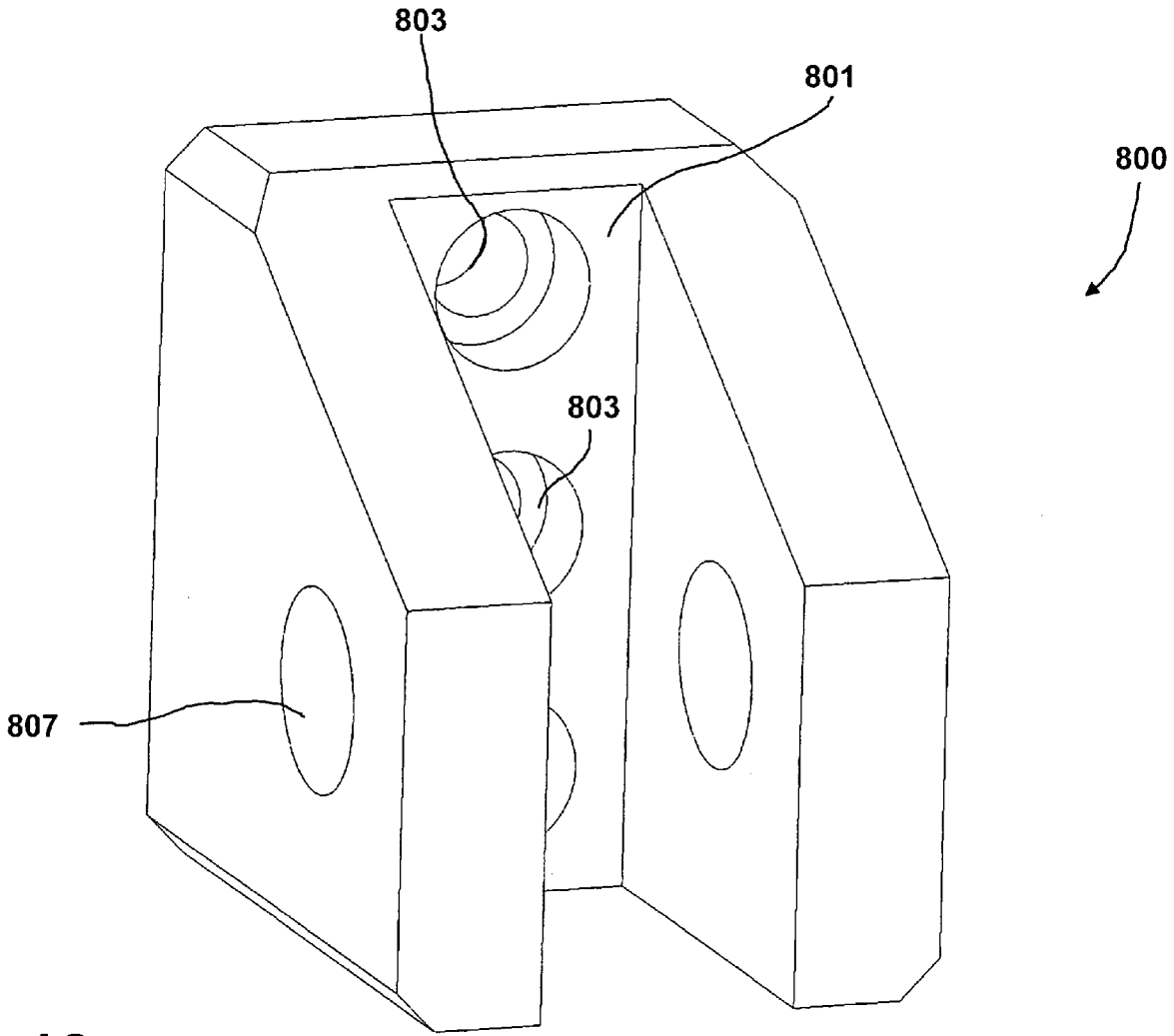
FIG. 18 is a perspective view of an anchor for the side entry sub of FIG. 5.
Figure 19:
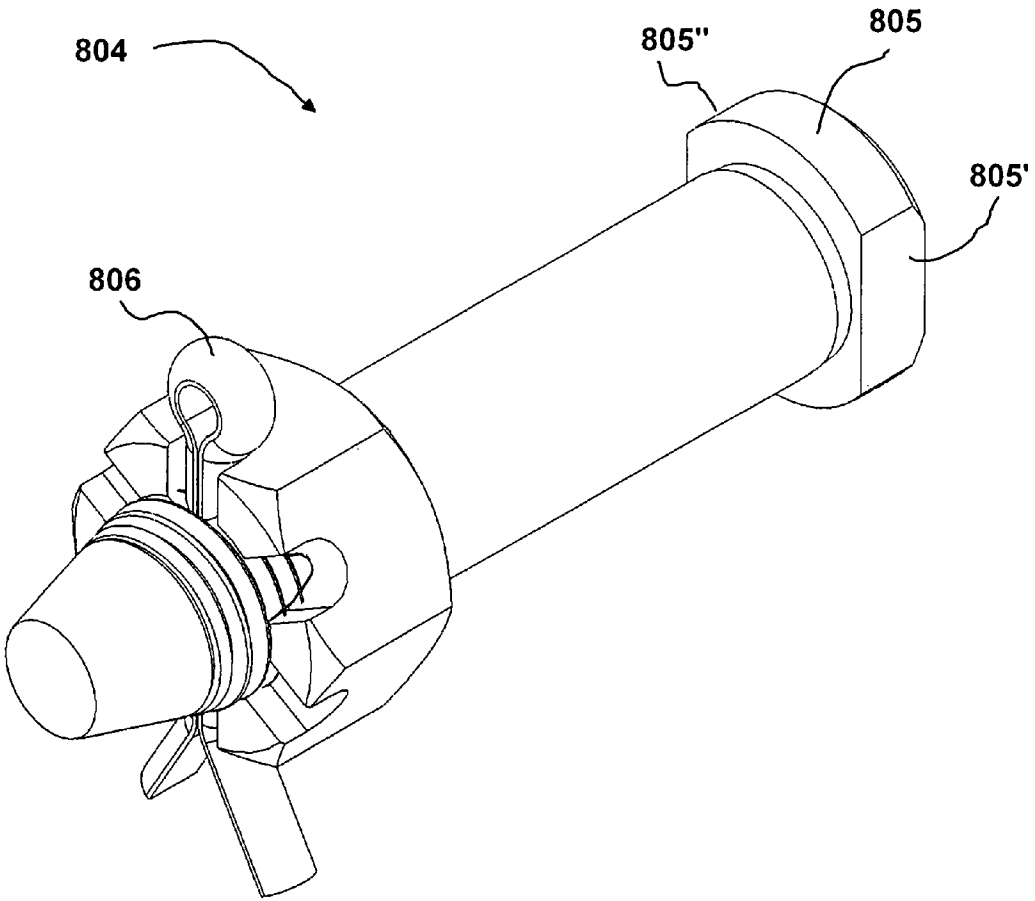
FIG. 19 is a perspective view of a threaded fastener for the side entry sub of FIG. 5.

FIG. 18 is a perspective view of upper anchor 800 which can be used to connect the first arm 310 to body 110. Upper Anchor 800 can include plurality of openings 803 to connect anchor 800 to body 110. In this vein, plurality of openings 803 can correspond to plurality of openings 803' in body 110. Upper anchor 800 can include support slot 801 and opening 807 for a fastener. First arm 310 can be connected to upper anchor 800 through opening 807. FIG. 19 is a perspective view of a threaded fastener 804. Fastener 804 can include head 805 on one end and a threaded area with nut on the other end. Locking pin 806 can be used to prevent nut from loosening during use of side entry sub 100. Head 805 can include flattened areas 805' and 805" which can either be used with a wrench or used to operatively connect to a countersunk portion of opening 807.

Lower anchor 820 can be constructed substantially the same as upper anchor 810 and include a plurality of openings 823 to connect anchor 820 to body 110. In this vein, plurality of openings 823 can correspond to plurality of openings 823' in body 110. Lower Anchor 820 can include support slot 821 and opening 827 for a fastener. Second arm 410 can be connected to lower anchor 820 through opening 827.

Figure 20:
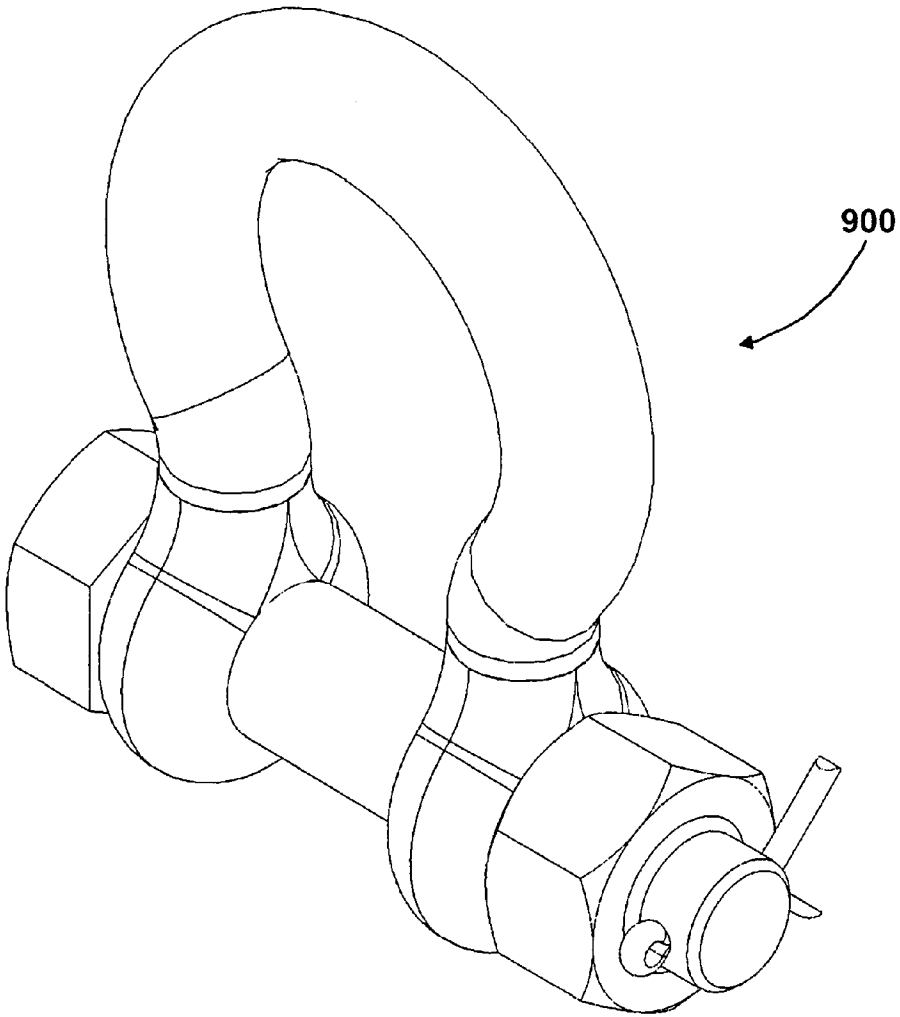
FIG. 20 is a perspective view of a shackle for the side entry sub of FIG. 5.

FIG. 20 is a perspective view of a shackle 900 which can be used in multiple places on sub 100. FIG. 6 provides four example places for shackle 900. Additionally, multiple shackles (e.g., 900, 91, 920, and/or 930) can be simultaneously used.

Figure 21:
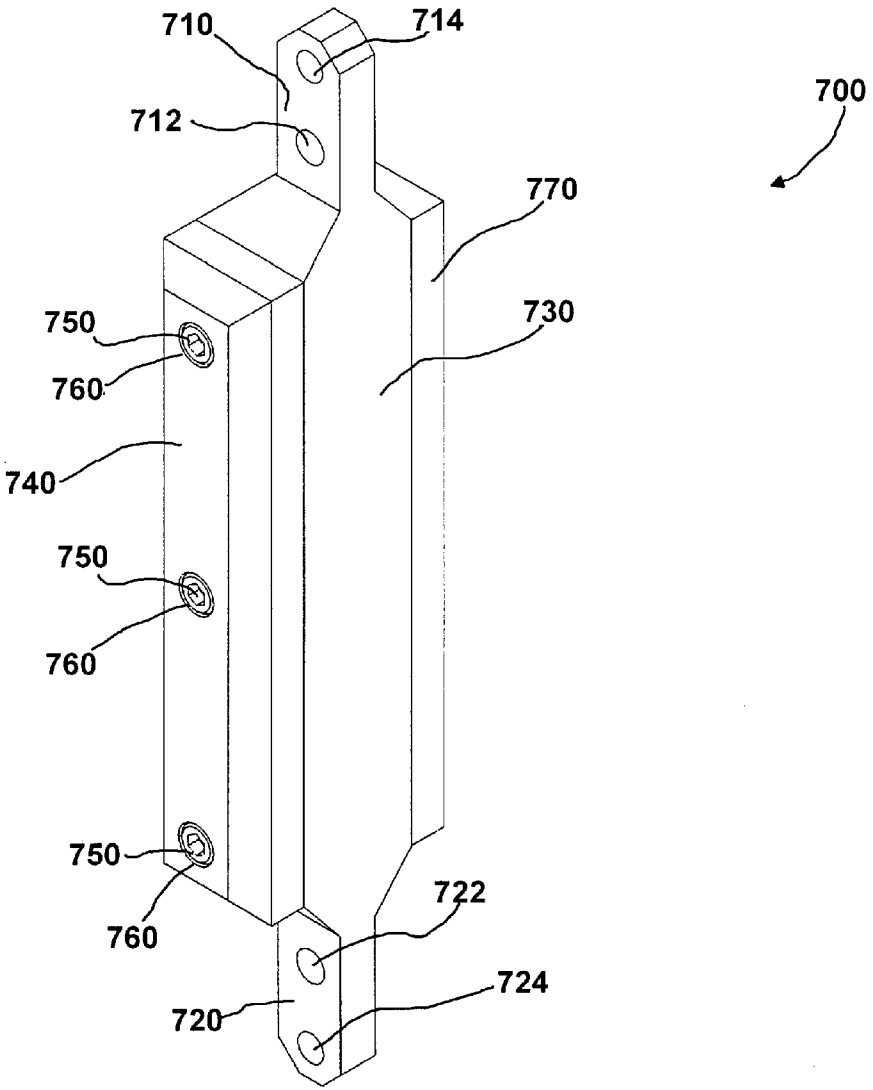
FIG. 21 is a perspective view of a detachable counterweight assembly for the side entry sub of FIG. 5.

FIG. 21 is a perspective view of a detachable counterweight assembly 700 for side entry sub 100. Counterweight assembly 700 is useful for controlling the longitudinal center of gravity of side entry sub 100, and countermanding the weight of valve 240, bracket 300, and the associated components. The heavier counterweight assembly (compared to the rest of side entry sub 100) the closer the longitudinal center is to counterweight assembly 700. FIG. 4 provides an example of a center of gravity for side entry sub 100' with valve 240 and brace 300 where the center of gravity is closer to valve 240. FIG. 3 provides an example of a center of gravity located substantially at the center of longitudinal passage 190.

Figure 22:
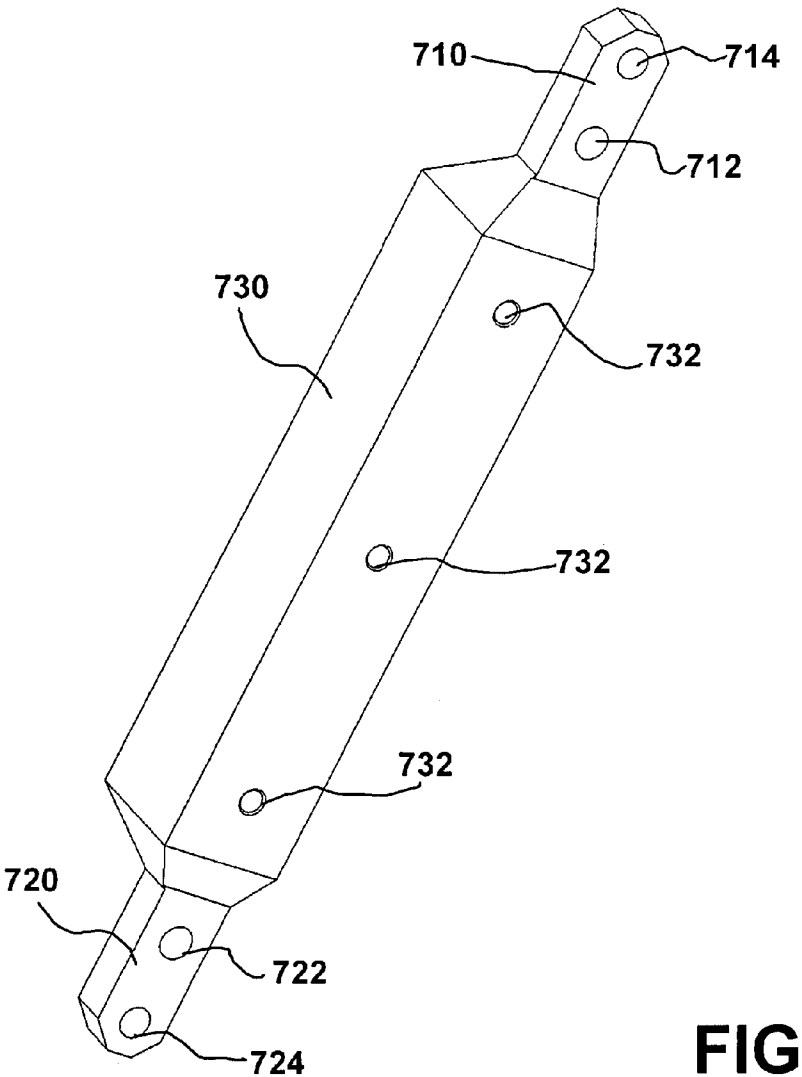
FIG. 22 is a perspective view of the body of the detachable counterweight assembly of FIG. 21.
Figure 23:
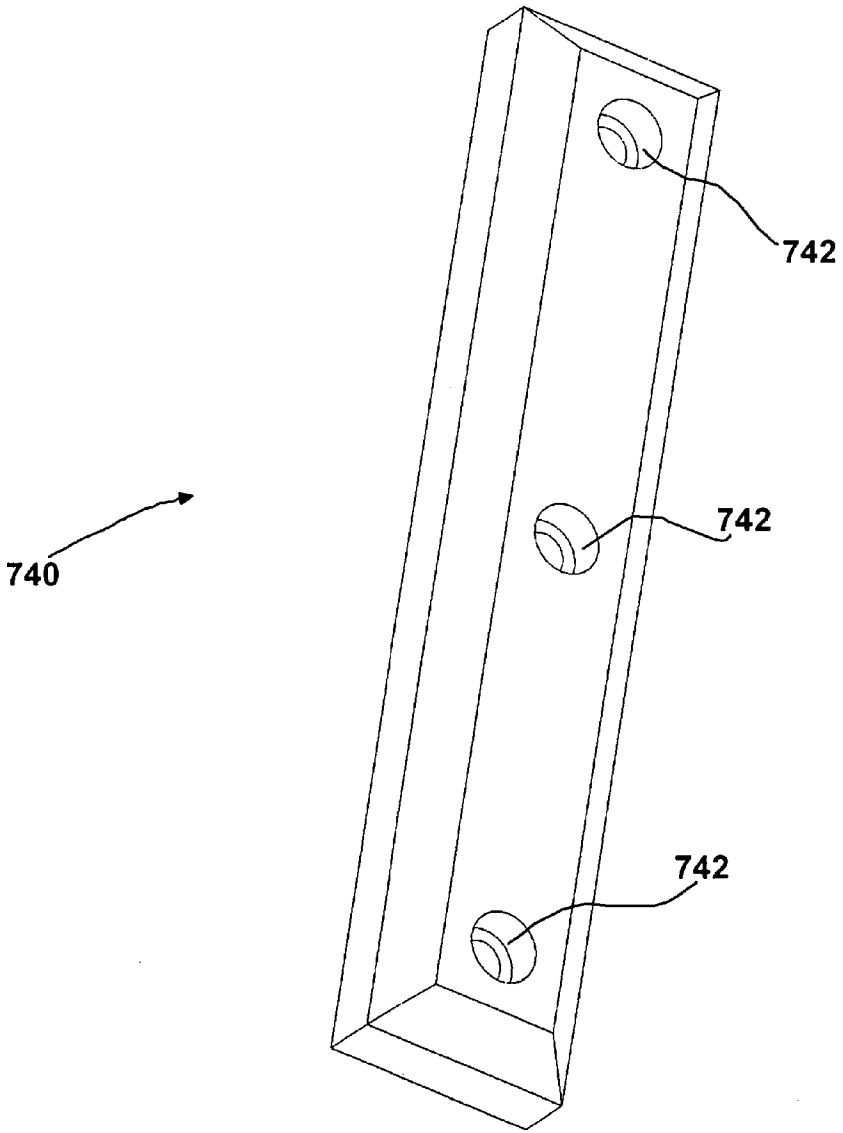
FIG. 23 is a perspective view of an individual weight for the counterweight assembly of FIG. 21.

Counterweight assembly 700 can comprise body 730 with one or more weight pieces 740, 770. FIG. 22 is a perspective view of body 730 and FIG. 23 is a perspective view of an individual weight piece 740. Each weight piece can include a plurality of openings 742 for attaching the weight piece to counterweight assembly 700. Preferably, each opening 742 is countersunk to allow the heads of threaded fasteners to fit flush with the exterior of each weight piece. In one embodiment a plurality of weight pieces with different weights for each weight piece can be provided to allow the overall weight of counterweight assembly 700 to be adjusted. Adjusting the overall weight of counterweight assembly allows for the adjustment of the position of longitudinal center of gravity for side entry sub 100.

In one embodiment is provided a side entry sub 100 especially useful for top drive rigs 1. In one embodiment is provided a side entry sub 100 that can be incorporated into a drill or well string 18,20 and enabling string sections both above and below the sub 100 to be reciprocated while providing a flow path between the exterior of the sub 100 and interior of the drill string while the drill string is being moved in a longitudinal direction (up or down). The interior of the side entry sub 100 can be fluidly connected to the longitudinal bore of casing or drill string 18,20 thus providing a path from the side entry inlet 200 to the interior of the casing/drill string.

In one embodiment is provided a method and apparatus for servicing a well wherein a side entry sub 100 is connected to and below a top drive unit 10 for conveying pumpable substances from an external supply through the side entry sub 100 for discharge into the well string 18,20, but bypassing the top drive unit 10.

In one embodiment is provided a method of conducting servicing operations in a well bore, such as cementing, comprising the steps of moving a top drive unit 10 longitudinally to provide longitudinal movement in the well bore of a well string 20 suspended from the top drive unit 10, and supplying a pumpable substance to the well bore 14 in which the drill or well 20 string is manipulated by introducing the pumpable substance at a point below the top drive power unit 10 and into the well string 20.

In other embodiments a side entry sub 100 is placed below the top drive unit 10 and can be used to perform jobs such as spotting pills, squeeze work, open formation integrity work, kill jobs, fishing tool operations with high pressure pumps, sub-sea stack testing, reciprocatation of casing during side tracking, and gravel pack or frack jobs. In still other embodiments a side entry sub can be used in a method of pumping loss circulation material (LCM) into a well to plug/seal areas of downhole fluid loss to the formation and in high speed milling jobs using cutting tools to address down hole obstructions. In other embodiments the side entry sub can be used with free point indicators and shot string or cord to free stuck pipe where pumpable substances are pumped downhole at the same time the downhole string/pipe/free point indicator is being reciprocated. In still other embodiments the side entry sub can be used for setting hook wall packers and washing sand.

In still other embodiments the side entry sub 100 can be used for pumping pumpable substances downhole when repairs/servicing is being done to the top drive unit 10 and reciprocation of the downhole drill string 20 is being accomplished by the top drive unit 10. Such use for reciprocation and pumping can prevent sticking/seizing of the drill string 20 downhole.

In still other embodiments safety valves, such as TIW valves, can be placed above and below the side entry sub 100 to enable routing of fluid flow and to ensure well control.

In one embodiment is provided a method of inserting a pre-made up side entry sub 100 in a drill or work string 18,20 comprising the steps of: (a) providing a side entry sub 100, the sub comprising: (i) a sub body 110 connected to and reciprocable with upper and lower drill or work string sections, the sub body having upper 130 and lower 150 end sections, front and rear portions, and a longitudinal passage 190 fluidly connecting the upper and lower sections; (ii) a side entry port 210 fluidly connected to the longitudinal passage 190; (iii) a valve 240 fluidly connected to the side port 210, the valve 240 being located on the front portion of the body 110; and (iv) a brace 300 connected to the body 110 and the valve 240, the brace 300 resisting the transfer of externally applied forces to the valve 240; (b) inserting the side entry sub 100 in the drill or work string 18,20; (c) connecting a chicksan line 1000 to the valve 240, the chicksan line 1000 having a weight; (d) wherein the brace 300 substantially reduces the transfer of the weight force from the chicksan line 1000 to the valve 240.

In various embodiments the brace 300 eliminates transfer of the weight from the chicksan line 1000 to the valve 240. In various embodiments the brace 300 reduces by at least fifty percent of the weight from the chicksan line 1000 to the valve 240; by at least seventy five percent; or by at least eighty percent; by at least ninety percent; by at least ninety five percent; by at least ninety six percent; by at least ninety seven percent; and/or by at least ninety eight percent; by at least ninety nine percent. In various embodiments the reduction can be a range between any of the above two specified percentages.

In various embodiments the reductions in transfer of load from the chicksan line is also directed to connections between the valve and the sub 100, or the sub 100 inlet.

In various embodiments the reduction in transfer of load is for a downwardly directed load. In various embodiments the reduction in transfer of load is for a upwardly directed load. In various embodiments the reduction in transfer of load is for a horizontally directed load. In various embodiments the reduction in transfer of load is for an angled load, compared to the vertical and horizontal directions.

In various embodiments, the sub 100 includes a counterweight 700 attached to the body 110, the counterweight 700 being located substantially on the opposite side of the body 110 as the valve 240.

In various embodiments the method includes the step of raising the sub 100 with a lifting sub 90 having an eyelet which hangs from a lifting line, wherein the sub 100 remains substantially vertical during this lifting step.

In various embodiments of the method, the drill or work string 18,20 is supported by a top drive unit 10, the top drive unit 10 raises and lowers the drill or work string 18,20 and sub 100, and the brace 300 raises and lowers the chicksan line 1000.

In various embodiments the chicksan line 1000 is raised and lowered without an individual 1120 attempting to independently raise and lower the chicksan line 1000 to prevent the weight of the chicksan line 1000 from being transferred to the valve 240, or the valve 240 connections, or the inlet connection to the sub 100.

In various embodiments at least part of the weight of the chicksan line 1000 is supported by the sub 100 body 110.

In various embodiments the sub 100 includes a shackle 920 (see e.g., FIG. 2), and the shackle 920 is connected to and supporting the chicksan line 1000, such as through auxiliary support 320 (which can be a line, chain, cord, arm, or other support).

In various embodiments, the counterweight 700 is detachably connectable to the sub 100, such as to the sub body 110.

In various embodiments, the counterweight 700 includes a body 730 and a plurality of counterweight weights 740,770, the counterweight weights 740,770 being detachably connectable to the counterweight body 730.

In various embodiments the brace 300 is a framework and the valve 240 is nested inside the framework (see e.g., FIG. 5). In one embodiment, the valve 240 has first and second sides, and the brace 300 includes first 330 and second 430 frame members respectively connected to the body 110 on the valve's 240 first side, both above and below the valve 240, and connected to the valve 240 on the valve's second side. In one embodiment the valve 240 is slidably connected to the brace 300 (schematically indicated by arrows 262). In one embodiment the framework is triangular in shape. In one embodiment, the brace 300 includes first 330 and second arms 430, each arm being connected to the sub body 110, and each arm being connected to each other. In one embodiment, a connector 500 connects each arm to the other. In one embodiment, the connector 500 includes a body 510 with upper 530 and lower 570 slots, and the one arm 330 connects in the upper slot 530, and the other arm 430 connects in the lower slot 570. In one embodiment, the connector's body 510 includes a bore 516 through the body, and the valve 240 is slidingly connected to the connector's body 510 through the bore 516.

In various embodiments, sub 100 includes a longitudinal passage 190 having a longitudinal center, and the sub 100 has a longitudinal center of gravity located substantially at the longitudinal center of the longitudinal passage 190.

In various embodiments is provided a method of offering for rental a pre-made up side entry sub 100 insertable in a drill or work string 18,20 comprising the steps of: (a) offering for rental a side entry sub 100, the sub comprising: (i) a sub body 110 connected to and reciprocable with upper and lower drill or work string sections 18,20, the sub body 110 having upper 130 and lower 150 end sections, front and rear portions, and a longitudinal passage 190 fluidly connecting the upper and lower sections; (ii) a side entry port 200 fluidly connected to the longitudinal passage 190; (iii) a valve 240 fluidly connected to the side port 200, the valve 240 being located on the front portion of the body 110; (iv) a brace 300 connected to the body 110 and the valve 240, the brace 300 resisting bending forces in the lower direction applied to the valve 240; and (v) a counterweight 700 attached to the body 110, the counterweight 700 being located substantially on the opposite side of the body 300 as the valve 240, each of these components being pre-made up for insertion into the drill or work string 18,20; and (b) taking an order for and delivering to a customer the pre-made up side entry 100.

In various alternative embodiments brace 300 can be attached to a top drive swivel, such as disclosed in published United States Patent Application publication number US 2007/0272403; U.S. Pat. No. 7,007,753; U.S. Pat. No. 7,281,582, all of which are incorporated herein by reference. In each case brace 300 can be constructed substantially the same as described in the instant application. However, each such brace 300 would be attached to the swivel sleeve 150 (or housing) in such applications and/or patents incorporated herein by reference—which sleeves 150 are rotatably connected to mandrels 40. In the case of U.S. Pat. No. 7,281,582; two braces 300 and 300' could be respectively attached to sleeves 1050 and 2050. In each case the particular brace 300 would resist the transfer of loading from an inlet connection located outside of the brace to the inlet connection to the sleeve (along with any valve and associate connections) between the brace and the inlet to the sleeve 150 or housing. In one case, the connection between brace 300 and sleeve 150 could include connection at the clamp 600. In one case upper and lower clamps 600, 600' could be provided where the upper and lower connections between brace 300 and sleeve 150 are made at the upper and lower clamps 600,600' which clamps are spaced at upper and lower levels of sleeve 150. This is because sleeve 150 is has a small amount of space for a bolted connection with brace 300. Alternatively, brace 300 can be welded.

The following is a list of reference numerals:

| (Reference No.) | (Description) |
|---|---|
| 1 | rig |
| 2 | crown block |
| 3 | cable means |
| 4 | travelling block |
| 5 | hook |
| 6 | gooseneck |
| 7 | swivel |
| 8 | drilling fluid line |
| 10 | top drive unit |
| 11 | draw works |
| 12 | cable |
| 13 | rotary table |
| 14 | well bore |
| 15 | guide rail |
| 16 | support |
| 17 | support |
| 18 | drill pipe |
| 20 | drill string or work string |
| 30 | arrows |
| 32 | arrows |
| 34 | arrow |
| 36 | arrow |
| 40 | arrow |
| 42 | arrow |
| 50 | arrow |
| 52 | arrow |
| 54 | arrow |
| 56 | arrow |
| 90 | lifting sub |

-continued

| (Reference No.) | (Description) |
|---|---|
| 100 | side entry sub |
| 110 | body |
| 120 | enlarged area |
| 122 | opening |
| 124 | plurality of openings or holes |
| 130 | upper end |
| 140 | box connection |
| 150 | lower end |
| 160 | pin connection |
| 170 | recessed area |
| 171 | upper shoulder |
| 172 | lower shoulder |
| 173 | plurality of openings |
| 175 | recessed area |
| 176 | upper shoulder |
| 177 | lower shoulder |
| 178 | plurality of openings |
| 180 | recessed area |
| 181 | upper shoulder |
| 182 | lower shoulder |
| 183 | plurality of openings |
| 185 | recessed area |
| 186 | upper shoulder |
| 187 | lower shoulder |
| 188 | plurality of openings |
| 190 | central longitudinal passage |
| 200 | inlet |
| 201 | recessed area |
| 202 | first end |
| 203 | plurality of openings |
| 204 | second end |
| 210 | radial passage |
| 220 | plurality of fasteners |
| 222 | plurality of openings for plurality of fasteners |
| 230 | quick connector |
| 240 | valve |
| 250 | quick connector |
| 260 | pipe |
| 262 | arrows |
| 270 | quick connector |
| 280 | swivel connection |
| 290 | inlet to swivel connection |
| 300 | brace |
| 301 | arrows |
| 302 | auxiliary support |
| 310 | first arm |
| 320 | first end |
| 322 | opening |
| 324 | opening for shackle |
| 330 | body |
| 340 | second end |
| 344 | openings for shackle |
| 342 | plurality of openings |
| 410 | second arm |
| 420 | first end |
| 422 | opening |
| 424 | opening for shackle |
| 430 | body |
| 440 | second end |
| 442 | plurality of openings |
| 500 | connection bracket |
| 510 | body |
| 512 | first end |
| 514 | second end |
| 516 | opening |
| 520 | top |
| 530 | slot |
| 540 | plurality of openings |
| 550 | plurality of fasteners |
| 560 | bottom |
| 570 | slot |
| 580 | plurality of openings |
| 590 | plurality of fasteners |
| 700 | counterweight |
| 710 | first end |
| 712 | opening |
| 714 | opening |

-continued

| (Reference No.) | (Description) |
|---|---|
| 720 | second end |
| 722 | opening |
| 724 | opening |
| 730 | body |
| 732 | plurality of openings |
| 740 | weight |
| 742 | plurality of openings |
| 750 | plurality of fasteners |
| 760 | plurality of locks, such as spring clamps |
| 770 | weight |
| 800 | first upper anchor |
| 801 | support slot |
| 802 | plurality of fasteners |
| 803 | plurality of openings for plurality of fasteners |
| 804 | fastener |
| 805 | head |
| 806 | locking pin |
| 807 | opening for fastener |
| 810 | second upper anchor |
| 812 | plurality of fasteners |
| 813 | plurality of openings for plurality of fasteners |
| 814 | fastener |
| 816 | locking pin |
| 820 | first lower anchor |
| 822 | plurality of fasteners |
| 823 | plurality of openings for plurality of fasteners |
| 824 | fastener |
| 826 | locking pin |
| 840 | second lower anchor |
| 842 | plurality of fasteners |
| 843 | plurality of openings for plurality of fasteners |
| 844 | fastener |
| 846 | locking pin |
| 900 | shackle |
| 910 | shackle |
| 920 | shackle |
| 930 | shackle |
| 940 | shackle |
| 1000 | chicksan line |
| 1100 | tugger line |
| 1102 | pulley for tugger line |
| 1110 | winch for tugger line |
| 1120 | operator for tugger line |
| 1500 | side entry sub |
| 1502 | inlet |
| 1510 | valve |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A side entry sub insertable into a drill or work string comprising:

(a) a sub body connected to and reciprocable with upper and lower drill or work string sections, the sub body having upper and lower end sections, front and rear portions, and a longitudinal passage fluidly connecting the upper and lower sections;

(b) a side entry port fluidly connected to the longitudinal passage;

(c) a valve fluidly connected to the side port, the valve being located on the front portion of the body;

(d) a brace connected to the body and the valve, the brace resisting bending forces in the lower direction applied to the valve;

(e) a counterweight attached to the body, the counterweight being located substantially on the opposite side of the body as the valve.

2. The side entry sub of claim 1, wherein the counterweight is detachably connectable to the body.

3. The side entry sub of claim 1, wherein the counterweight includes a body and a plurality of counterweight weights, the counterweight weights being detachably connectable to the counterweight body.

4. The side entry sub of claim 1, wherein the brace includes first and second arms, each arm being connected to the sub body, and each arm being connected to each other.

5. The side entry sub of claim 4, wherein a connector connects each arm to the other.

6. The side entry sub of claim 5, wherein the connector includes a body with upper and lower slots, and the one arm connects in the upper slot, and the other arm connects in the lower slot.

7. The side entry sub of claim 6, wherein the connector's body includes a bore through the body.

8. The side entry sub of claim 7, wherein the valve is slidingly connected to the connector's body through the bore.

9. The side entry sub of claim 1, wherein longitudinal passage has a longitudinal center and the sub has a longitudinal center of gravity located substantially at the longitudinal center of the longitudinal passage.

* * * * *